US006463635B2

(12) United States Patent
Murasaki

(10) Patent No.: US 6,463,635 B2
(45) Date of Patent: Oct. 15, 2002

(54) SURFACE FASTENER

(75) Inventor: Ryuichi Murasaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/893,630

(22) Filed: Jun. 29, 2001

(65) Prior Publication Data

US 2002/0023322 A1 Feb. 28, 2002

(30) Foreign Application Priority Data

Jun. 30, 2000 (JP) ..... 2000-199477
Dec. 22, 2000 (JP) ..... 2000-391196

(51) Int. Cl.[7] ..... A44B 18/00
(52) U.S. Cl. ..... 24/452; 24/306; 24/442
(58) Field of Search ..... 24/306, 442, 443, 24/444, 447, 450, 452; 428/99, 100

(56) References Cited

U.S. PATENT DOCUMENTS 4,617,214 A * 10/1986 Billarant ..... 428/40.1
4,842,916 A 6/1989 Ogawa et al.
4,931,344 A * 6/1990 Ogawa et al. ..... 428/100
5,058,245 A * 10/1991 Saito ..... 24/306
5,606,781 A * 3/1997 Provost et al. ..... 24/452
5,766,723 A * 6/1998 Oborny et al. ..... 428/100
5,786,061 A * 7/1998 Banfield ..... 428/100
6,148,487 A * 11/2000 Billarant ..... 24/442

FOREIGN PATENT DOCUMENTS

EP 0 439 969 A1 8/1991
JP 2788564 8/1993
WO WO 98/05232 2/1998

OTHER PUBLICATIONS

British Search Report for Application No. GB0114716.4 dated Oct. 16, 2001.

* cited by examiner

*Primary Examiner*—Robert J. Sandy
(74) *Attorney, Agent, or Firm*—Finnegan, Henderson, Farabow, Garrett, & Dunner, LLP

(57) ABSTRACT

In a strip-shaped surface fastener, fence portions, each of which periphery is blocked, integrally stand on a surface of a flat base portion made of synthetic resin. The fence portions may be formed of foam members and bonded to the surface of the flat base portion. Then, male type engaging elements are integrally molded inside each of the fence portions. Alternatively, a woven or knitted male type, female type or male-and-female mixture type surface fastener member, or a male type surface fastener member made of synthetic resin may be pasted or bonded inside each of the fence portions. An attaching portion, in which no engaging elements are disposed, are integrally formed on an outer periphery of each of the fence portions. Therefore, it is possible to prevent foam resin material from penetrating an interior of each of the fence portions during an embedding operation and to effectively embed the surface fastener in a cushion body of a foam resin molding type. Consequently, the surface fastener can be embedded in a stable fashion in a seat molded of foam resin without losing an engaging force of the surface fastener.

14 Claims, 20 Drawing Sheets

SURFACE FASTENER

BACKGROUND OF THE INVENTION

1. Field of the Invention

The present invention relates to a surface fastener, which is used as a stopper for attaching a superficial skin member on a surface of a cushion body, for example, in a seat of a vehicle or a home seat such as a shitting chair or a sofa. More particularly, the present invention relates to a surface fastener, which is strongly embedded and fixed in a stable manner in the cushion body upon molding the cushion body by a foam molding.

2. Description of the Related Art

Conventionally, this kind of surface fastener is disclosed in Japanese Utility Model Publication No. 6-37712. As shown in FIG. 33, a strip-shaped woven surface fastener 8' is provided with portions in which no hook-shaped engaging elements 4' are arranged at end margins 3' on opposite sides of a surface thereof. At these end margins 3', members, which constitute of non-woven cloth NW' and have nearly equal heights as those of the engaging elements 4', are attached along a longitudinal direction of the surface fastener 8', so that foam resin material is prevented from penetrating the surface, on which the engaging elements 4' of the surface fastener are planted, during the molding of a cushion body.

Another conventional molded surface fastener is disclosed in Japanese Patent No. 2788564. As shown in FIG. 34, the molded surface fastener has a fin-shape enclosing portion 2", which extends on a periphery of a base member 1" made of synthetic resin and inclines in an outer oblique direction. Inside of this enclosing portion 2", engaging elements 4" of the surface fastener are planted. A number of fixing legs 32", each of which has an enlarged head 33" for planting and fixing, are disposed on a rear surface of the base member 1". The respective base members 1" are connected to each other with connecting threads 31". As a result, foam resin material is prevented from penetrating the surface, on which the engaging elements 4" of the surface fastener are planted, upon molding the cushion body.

The strip-shape woven surface fastener 8' as described above and shown in FIG. 33 is, however, provided with the portion on which the engaging elements 4' of the surface fastener 8' are not arranged at the end margins 3' on the opposite sides of the surface thereof, and these end margins 3' are attached with non-woven cloth NW' having the nearly equal height as those of the engaging elements 4' of the surface fastener 8' along the longitudinal direction of the surface fastener 8' by a supersonic processing, a high-frequency processing or the like. Further, this surface fastener 8' is inserted in a hollow groove disposed on a surface of a metal mold upon molding the cushion body to close the edge portions of the hollow groove by the non-woven cloth, so that the foam resin material is prevented from penetrating the surface of the engaging elements 4'. Therefore, after the edge margins 3' of the surface fastener 8' is embedded in the cushion body, it is possible that a portion of the edge margins 3' of the strip-shaped surface fastener 8' may be pulled out of the foam mold body by a pulling force of a loop surface fastener attached to the superficial skin of the seat in use. Thus, there is a deficiency with regard to an attachment strength of the surface fastener 8'. Furthermore, since the engaging elements 4' of the surface fastener 8' are attached so as to stand out from the surface of the cushion, the attached portion makes a user feel uncomfortable.

Further, in the molded surface fastener as shown in FIG. 34, since the enclosed area of the base member, on which the engaging elements 4" of the surface fastener are planted, is blockaded by the fin-shape enclosing portion 2" inclining in the outer oblique direction and an outer surface of the enclosing portion 2" is smooth, the molded surface fastener is embedded and fixed in the cushion body made of foam resin by the fixing legs, which are disposed on the rear surface of the base member 1". Therefore, it is not possible that a front edge of the enclosing portion 2" disposed on the periphery of the base member 1" is strongly embedded in a stable fashion in the cushion body made of foam resin, so that the molded surface fastener becomes unstable. As a result, the enclosing portion 2" may tremble during the use.

SUMMARY OF THE INVENTION

The present invention has been made taking the foregoing problem into consideration. A main object of a first aspect of the present invention is to provide a surface fastener having an excellent engagement force, in which a base portion of the surface fastener can be very simply and strongly fixed on a cushion body of a foam resin molding type by using the surface fastener without providing a specific processing to a foam metal mold, foam resin material is prevented from penetrating the surface fastener specifically upon molding the cushion body, such as a cushion for a seat, on the surface fastener, and a fence portion formed in a periphery of the surface fastener or a fence portion made of thermoplastic resin foam is strongly connected to the cushion body so that the surface fastener is capable of being used in a stable state. Further, this surface fastener is provided with an attaching portion that can be easily attached.

A further object of the present invention is to provide a surface fastener, which is provided with fence portions and has attaching portions defined not only in a longitudinal direction of the surface fastener but also in the peripheries thereof including both sides thereof so that the surface fastener can be attached easily.

A further object of the present invention is to provide a surface fastener, which is very easy to manufacture and which has flexibility and a high quality.

A further object of the present invention is to provide a surface fastener, which is easy to use and which can be either a single or a plurality of surface fasteners produced from a strip-shaped surface fastener depending on a place and a purpose for its use.

A further object of the present invention is to provide a surface fastener, which is provided with a mechanism for effectively connecting a rear surface of a base portion of the surface fastener to a cushion body of a foam resin molding type, so as to be more strongly embed the base portion in the cushion body. The mechanism may include fixing yarns, for example.

A further object of the present invention is to provide a surface fastener, which is provided with a mechanism for strongly connecting the rear surface of the base portion of the surface fastener to the cushion body of the foam resin molding type, so as to more strongly embed the base portion in the cushion body. The mechanism may include, for example, a cloth such as a female surface fastener member or a non-woven cloth that the foam resin material can penetrate.

A further object of the present invention is to provide a surface fastener, which is provided with a mechanism for more strongly connecting the rear surface of the base portion of the surface fastener to the cushion body of the foam resin molding type. The mechanism may include engaging elements for fixing, for example.

A further object of the present invention is to provide a surface fastener, which applies magnetic powder in an appropriate form and accurately effects its function in such a manner that the base portion of the surface fastener is placed accurately in a stable fashion in a metal mold.

A further object of the present invention is to provide a surface fastener, which has flexibility and free from uncomfortable touch in use, and which is easy to manufacture.

A further object of the present invention is to provide a surface fastener, which can be supported such that the surface fastener having flexibility and a high quality is disposed in a stable fashion upon molding the cushion body of the foam resin molding type.

A further object of the present invention is to provide a surface fastener, which is provided with a specified configuration of the fixing yarns to be disposed on the base portion of the surface fastener, which can support the embedding and fixing of the base portion of the surface fastener and in which the foam resin material can effectively penetrate and solidify.

A further object of the present invention is to provide a surface fastener, which applies magnetic powder in an appropriate form and accurately effects its function in such a manner that the fixing yarns mounted to the base portion of the surface fastener are placed accurately in a stable fashion in a metal mold.

In order to attain the above described objects, according to the present invention, there is provided a surface fastener, comprising a strip-shaped flat base portion made of thermoplastic resin such as polyamide, polyester, polypropylene or the like, a number of fence portions arranged in a row on a surface of the base portion, a periphery of each of the fence portions being blocked, engaging elements planted inside each of the fence portions, and an attaching portion, where no engaging elements are disposed, integrally defined between the respective fence portions. The engaging elements may be male type engaging elements of a molded surface fastener, which are to be integrally planted in the base portion, or male type engaging elements of a separate molded surface fastener, or male or female type engaging elements of a separate woven or knitted surface fastener that is to be disposed on the base portion.

Preferably, there is provided a surface fastener in which an attaching portion, on which no engaging elements are disposed, are not only defined between the respective fence portions formed on the surface of the strip-shaped base portion but also defined on each side of the respective fence portions. As a result, the attaching portions are defined on the peripheries of the fence portions.

Still further preferably, there is provided a surface fastener in which the fence portions standing on the strip-shaped base portion are molded of thermoplastic resin by injection molding processing means or extruding molding processing means so that the base portion and the fence portions are integrated to each other.

Still further preferably, there is provided a surface fastener in which the fence portions formed of thermoplastic resin foam members such as polyurethane, polystyrene, polyethylene, polypropylene or the like are bonded on the surface of the strip-shaped base portion by using resin adhesive, or by pressing the thermoplastic resin foam members to the base portion in a semi-molten state so that molten resin can be adhered to the foam members.

Still further preferably, there is provided a surface fastener in which the fence portions arranged in a row on the strip-shaped base portion are to be cut at an interspace between the fence portions. As a result, a surface fastener piece comprising a single fence portion or a plurality of the fence portions can be obtained, depending on a place and a purpose for its use.

Still further preferably, there is provided a surface fastener in which fixing yarns, which are formed by entwining synthetic fibers, are appropriately fixed on the rear surface of the base portion or/and on the attaching portion.

Alternatively, there may be provided a surface fastener in which a cloth which foam resin material can penetrate when a cushion body is being molded, such as a female type surface fastener member, a non-woven cloth or the like, are disposed on a rear surface of the base portion made of thermoplastic resin.

Further alternatively, there may be provided a surface fastener in which fixing elements, each of which has an enlarged head, are integrally molded on the rear surface of the base portion made of thermoplastic resin so that the surface fastener can be strongly embedded in the cushion body.

Still further preferably, there is provided a surface fastener in which resin adhesive or resin coating mixed with magnetic powder such as metal powder or the like is applied on the rear surface of the base portion made of thermoplastic resin so that a magnetic film layer can be formed on the rear surface of the base portion. As a result, the surface fastener can be fixed in a stable fashion in the cushion body.

Still further preferably, there is provided a surface fastener in which the strip-shaped base portion and the engaging elements are integrally molded to each other by injection molding processing means or extruding molding processing means, using thermoplastic resin mixed with magnetic powder.

Still further preferably, there is provided a surface fastener in which a woven or knitted surface fastener member is bonded or pasted on an interior of each of the fence portions formed on the strip-shaped base portion made of thermoplastic resin.

Still further preferably, there is provided a surface fastener in which the base portion made of thermoplastic resin and the fence portions formed of thermoplastic resin foam members are bonded to each other by using resin adhesive mixed with magnetic powder such as metal powder or the like.

Still further preferably, there is provided a surface fastener in which the fixing yarns which are disposed on the rear surface of the base portion made of thermoplastic resin, are formed to be thick by entwining synthetic fibers which are varied in crimp percentage.

Still further preferably, there is provided a surface fastener in which magnetic material such as metal fibers or synthetic fibers that are applied with resin coating mixed with magnetic metal powder is mixed or included in the fixing yarns.

DESCRIPTION OF THE EMBODIMENTS

Embodiments of a surface fastener according to the present invention will be explained below with reference to the accompanying drawings.

Figure 1:
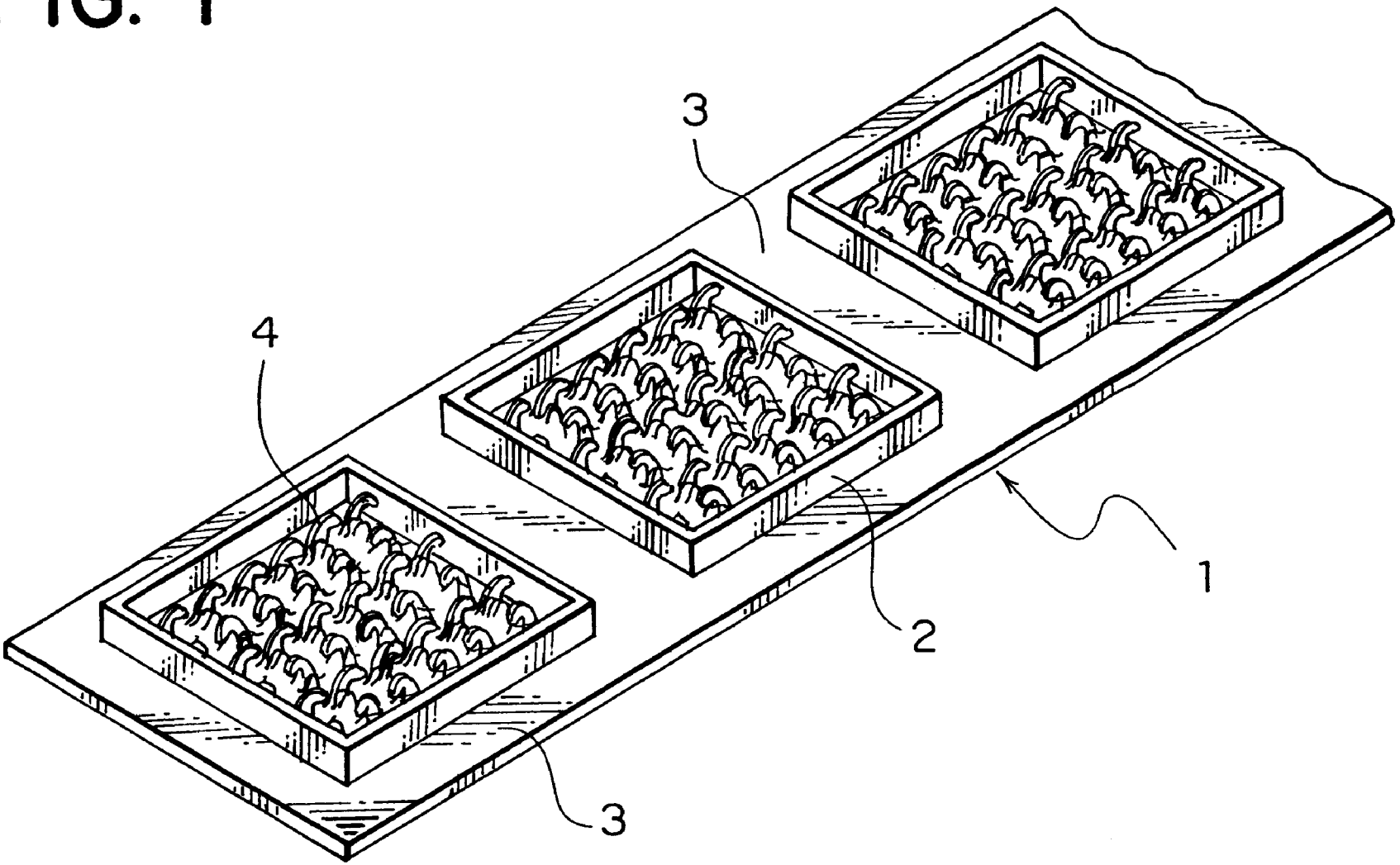
FIG. 1 is a perspective view of a strip-shaped surface fastener.

As shown in FIG. 1, the surface fastener according to the present invention comprises a strip-shaped base portion 1 and fence portions 2, each of which may be a quadrate, a rectangle, a circle or an ellipse and is blocked off and blockaded, integrally arranged in a row with a space therebetween on a surface of the surface fastener. Further, Many male type engaging elements 4 of the surface fastener, which are equal to or slightly lower than that of the fence portions 2 in height, are integrally molded inside the respective fence portions 2. Between the respective fence portions 2, flat attaching portions 3, on which no engaging elements 4 are present, are defined. Similarly, on both outsides of the respective fence portions 2, flat attaching portions 3, on which no engaging elements 4 are present, are defined. In other words, the attaching portions 3 are formed around the respective fence portions 2.

All of the fence portions 2 and the engaging elements 4, which are formed on the surface of the strip-shaped base portion 1, are integrally molded by an injection molding processing means or an extruding molding processing means using thermoplastic resin such as polyamide, polyester, polypropylene or the like so that a large number of hook-shaped engaging elements 4 are formed so as to protrude inside the respective fence portions 2.

Figure 2:
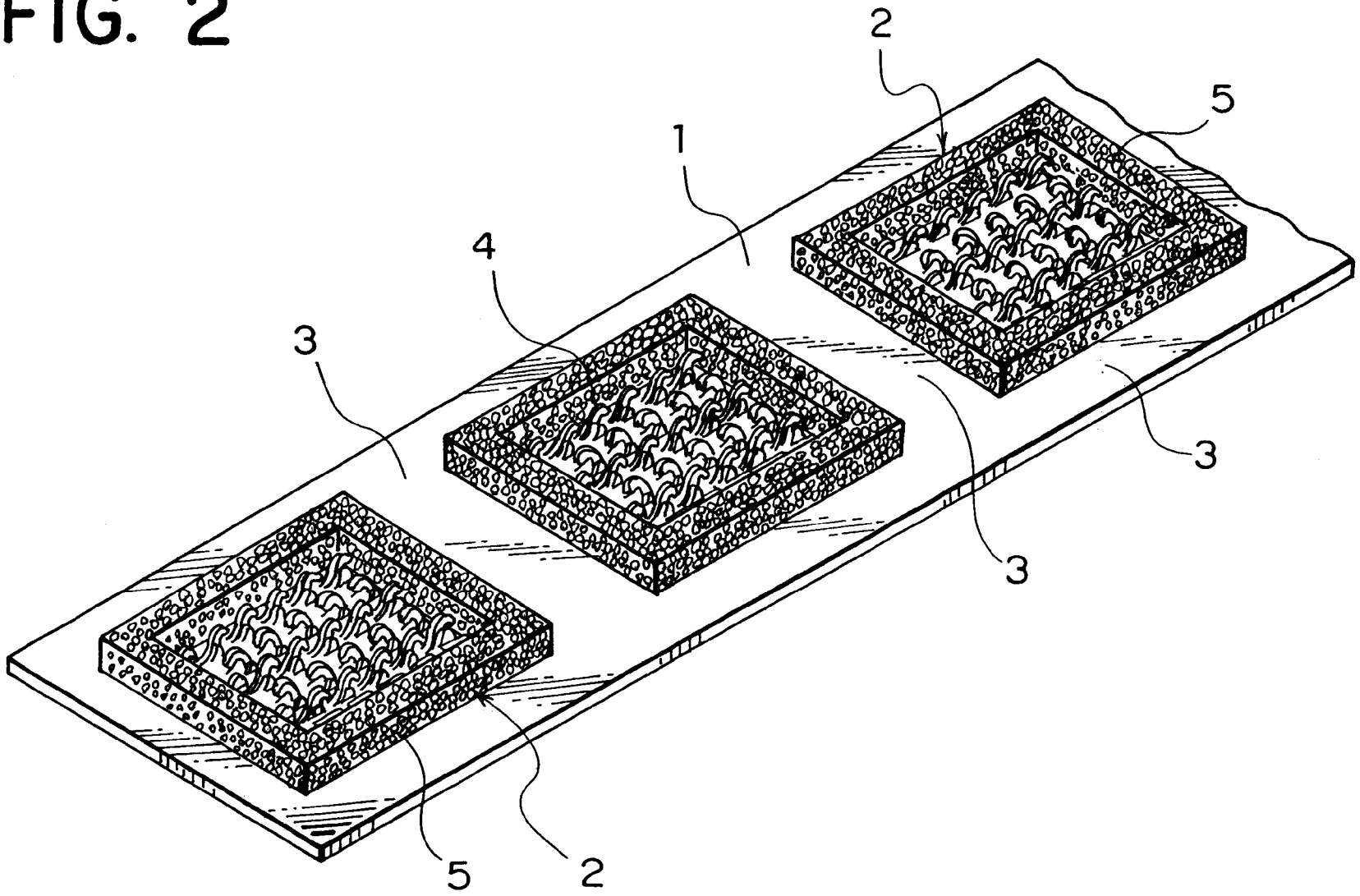
FIG. 2 is a perspective view of a strip-shaped surface fastener provided with a fence portion made of foam.

In a surface fastener shown in FIG. 2, groups of engaging elements, each of which composes of a multiplicity of engaging elements 4, are integrally molded in an area having a narrower width than that of the base portion 1 with a predetermined space on a surface of a strip-shaped base portion 1 made of thermoplastic resin. Then, these engaging element groups are surrounded by the corresponding fence portions 2, each of which has a narrower width than that of the base portion 1. As a result, the attaching portions 3, on which no engaging elements 4 are disposed, are defined between the respective fence portions 2 and on both outsides of the fence portions 2. The fence portions 2 are separated from the base portion 1. The surface fastener can be obtained by foam processing thermoplastic resin such as polyurethane, polystyrene, polyethylene, polypropylene or the like to form a foam member 5 in shape of a square frame and then bonding the foam member 5 on the surface of the base portion 1 via an adhesive layer 20 which is made of resin adhesive or the like so that the fence portions 2 are formed. Alternatively, a resin adhesive mixed with magnetic metal powder may be used to provide an adhesive layer 20 for bonding the foam member 5 on the surface of the base portion 1, which enables the surface fastener to be secured to a magnet disposed in a metal mold 11.

Further alternatively, the foam member 5 may be pressed to the base portion 1 which is in a semi-molten state so that the foam member 5 is dipped with molten resin to be bonded to the base portion 1. Consequently, the fence portions 2 are formed.

Figure 3:
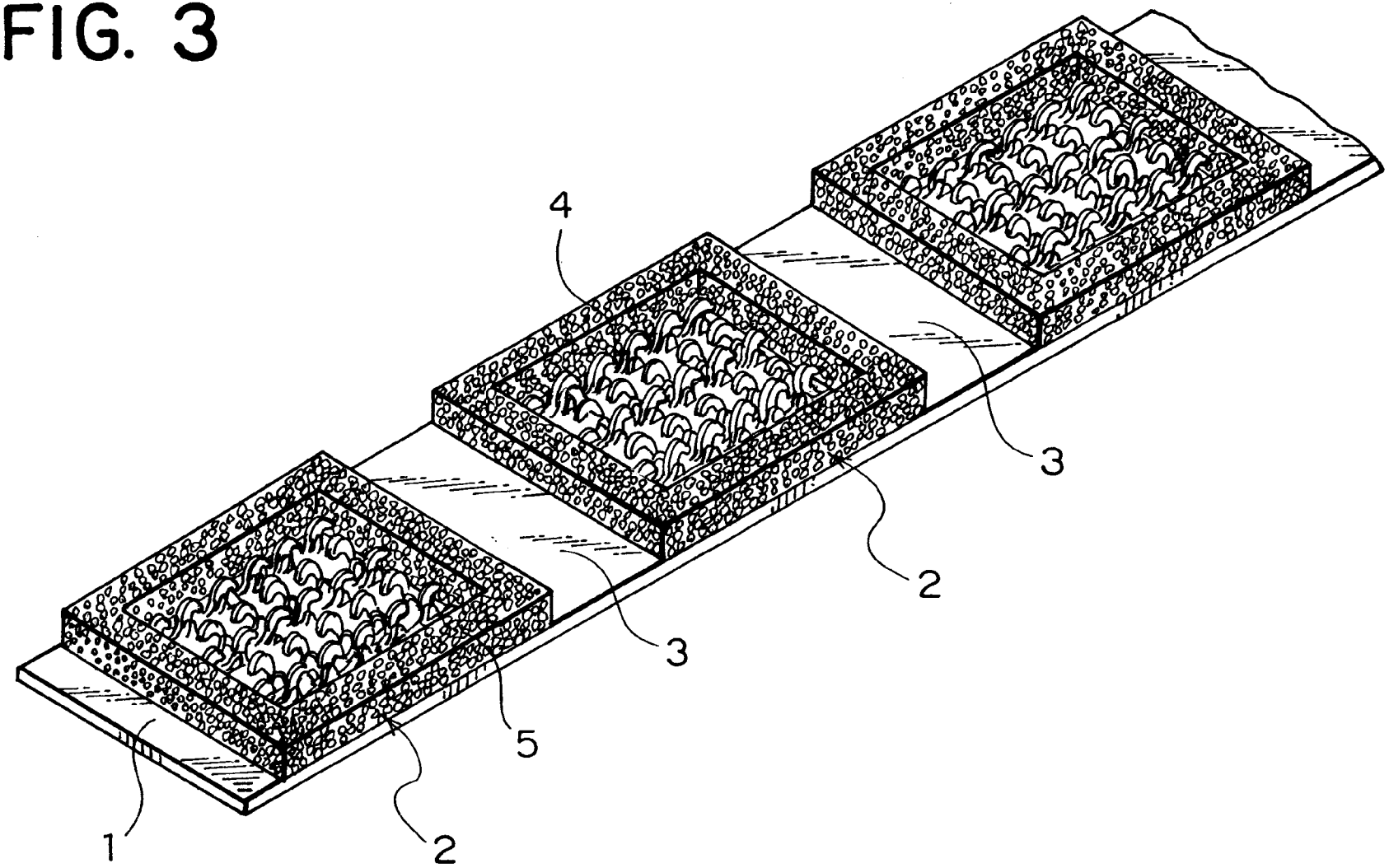
FIG. 3 is a perspective view of a strip-shaped surface fastener provided with fence portions made of foam.

In a surface fastener shown in FIG. 3, engaging element groups, each of which composes of a multiplicity of engaging elements 4, are integrally molded in a area having a narrower width than that of the base portion 1 with a predetermined space on a surface of a strip-shaped base portion 1 made of thermoplastic resin. Then, these engaging element groups are surrounded by the corresponding fence portions 2, which are formed by the foam members 5 having the same width as that of the base portion 1. Thus, the base portion 1 and the fence portions 2 of the foam members 5 are bonded to each other in the same manner as the above described embodiment, so that the surface fastener is completed. Consequently, the attaching portions 3, on which no engaging elements 4 are disposed, are defined between the respective fence portions 2.

Figure 4:
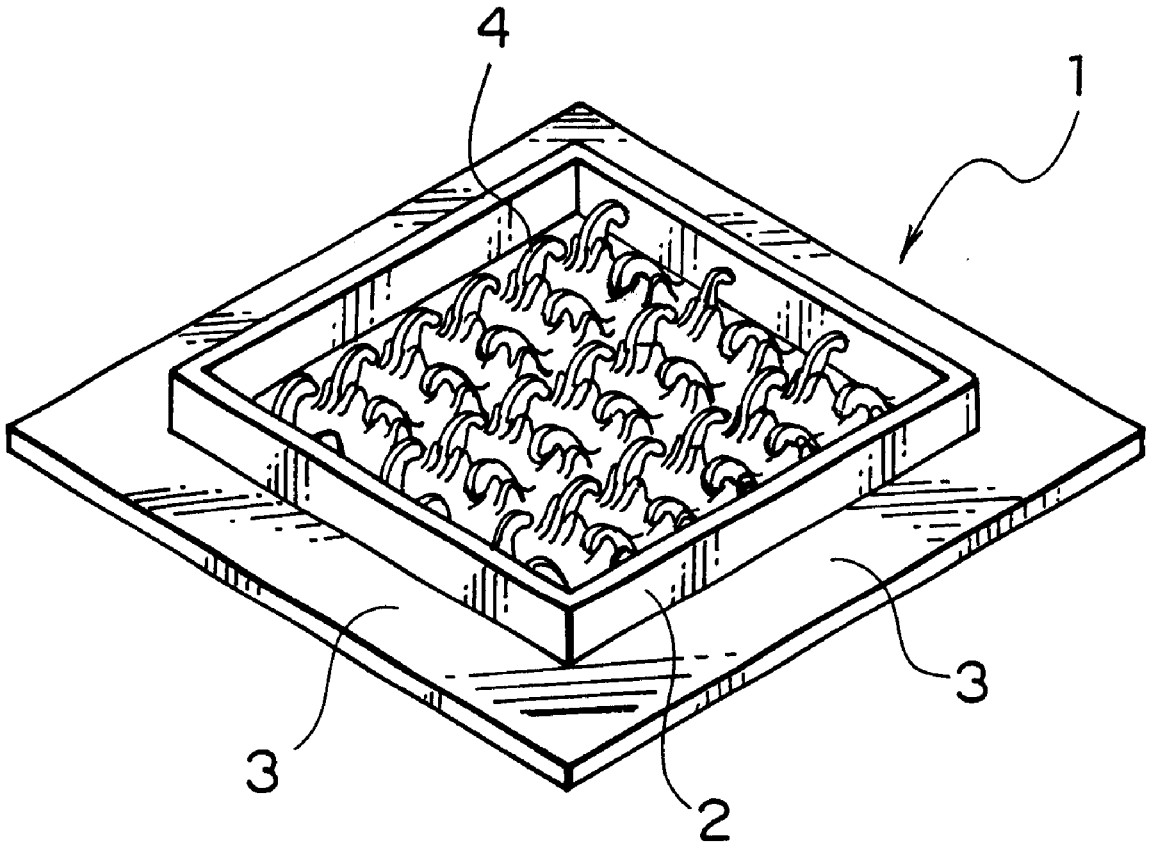
FIG. 4 is a perspective view of a surface fastener piece of the surface fastener shown in FIG. 1.
Figure 5:
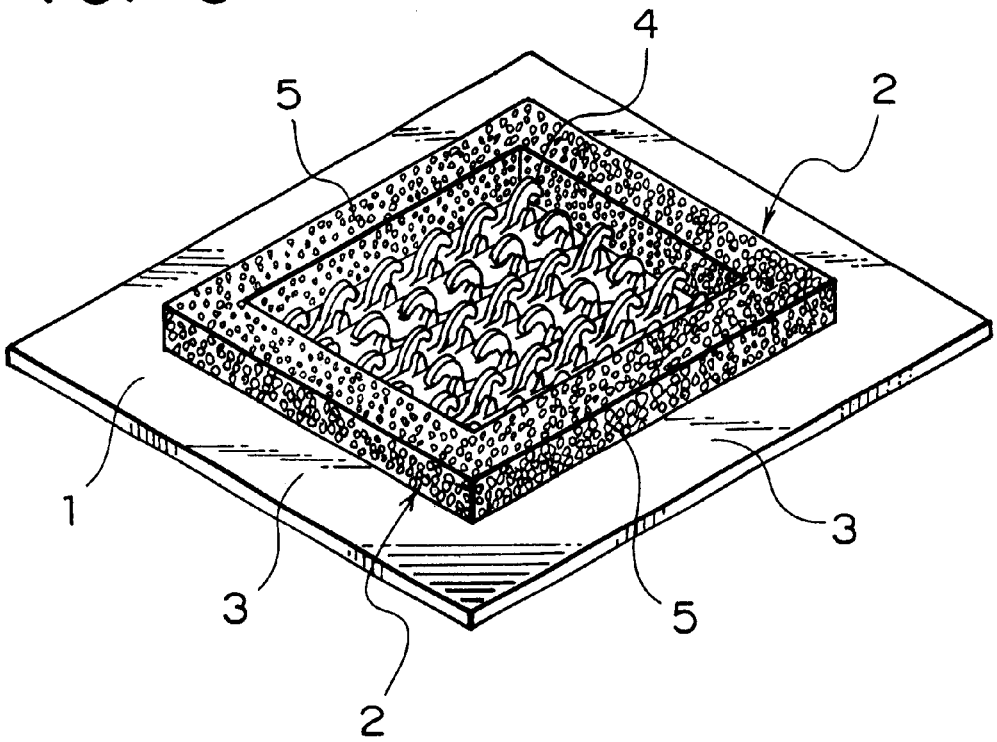
FIG. 5 is a perspective view of a surface fastener piece of the surface fastener shown in FIG. 2.
Figure 6:
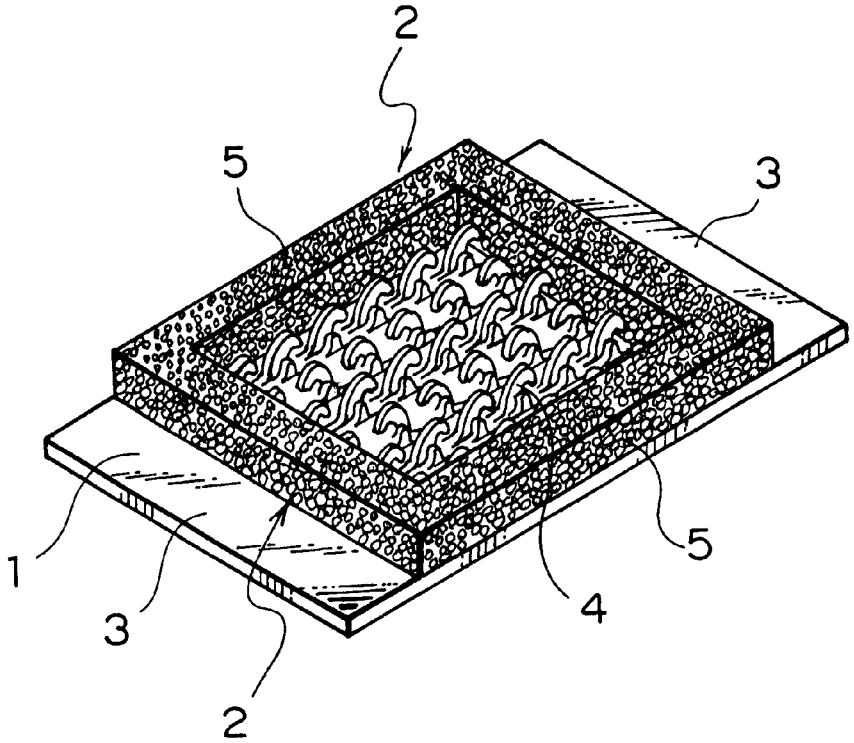
FIG. 6 is a perspective view of a surface fastener piece of the surface fastener shown in FIG. 3.

Each of the strip-shaped surface fasteners shown in FIGS. 1 to 3 is cut into surface fastener pieces, each of which comprises a single fence portion 2 as shown in FIGS. 4 to 6 depending on a place and a purpose for use. Further, they may be cut with a plurality of fence portions 2 being arranged in a row, although it is not shown.

Figure 7:
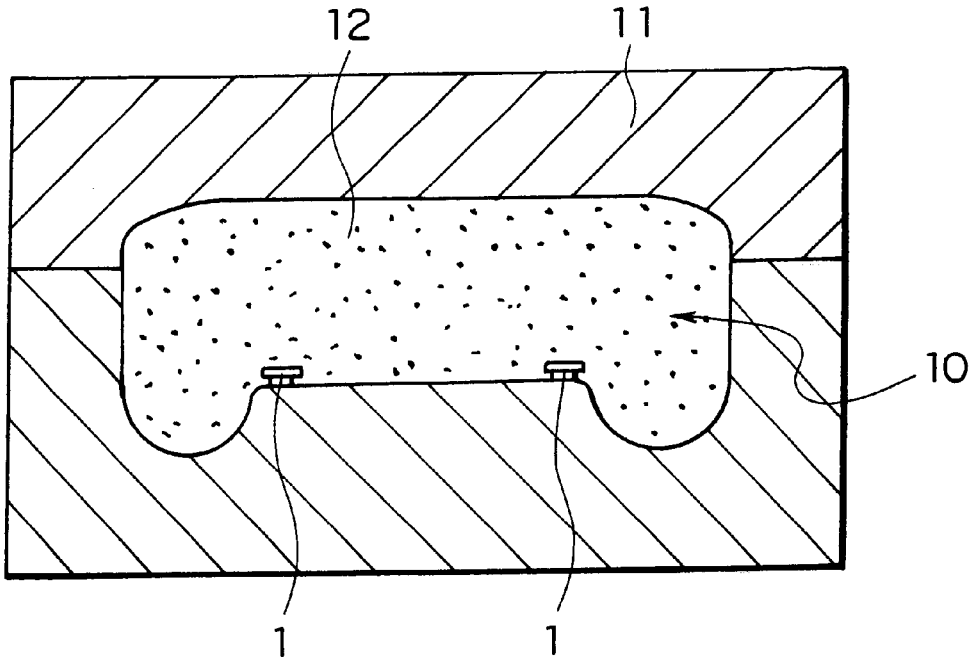
FIG. 7 is a cross sectional view showing a state in which the surface fastener is set in a metal mold.

As shown in FIG. 7, with respect a molded surface fastener, a foam resin material 12 is injected and foamed in the metal mold 11 for molding a cushion body 10 of a seat. At this time, if the foam resin material 12 is foamed while top ends of the fence portions 2 of the surface fastener contact the metal mold 11, the cushion body 10 wraps the attaching portions 3 placed in the peripheries of the fence portions 2, so that the fence portions 2 are embedded and fixed in the cushion body 10. Consequently, the cushion body 10 can be molded such that the top ends of the fence portions 2 and the top ends of the engaging elements 4 do not protrude from the surface of the cushion body 10, respectively.

Figure 8:
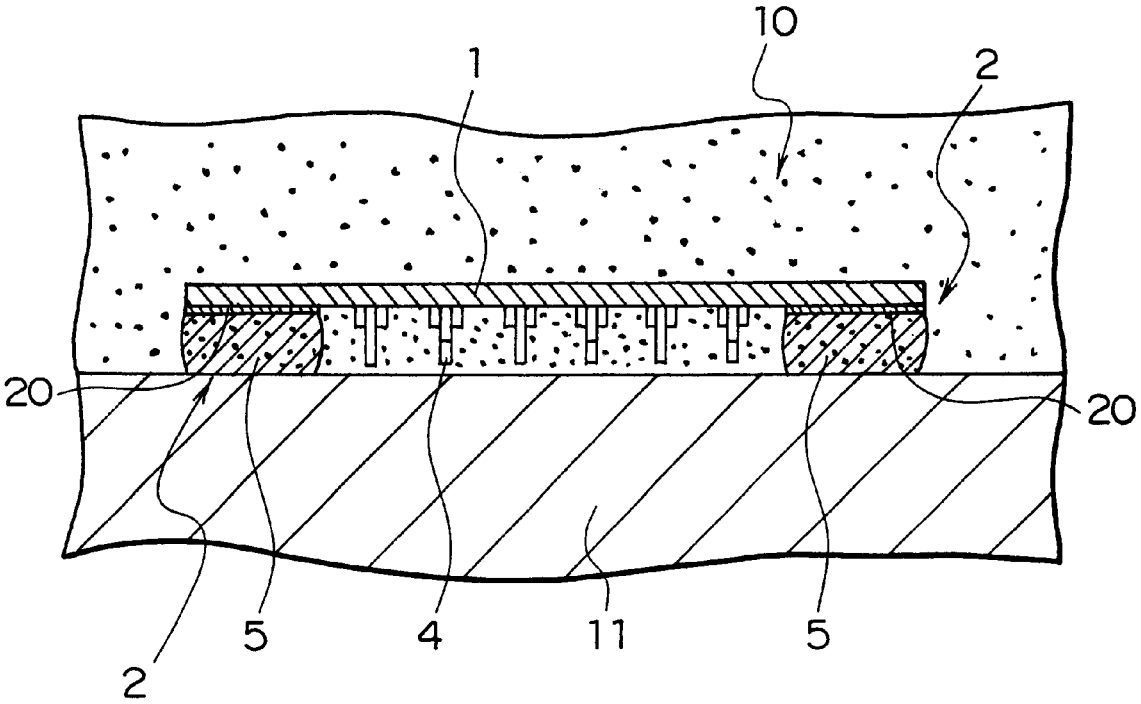
FIG. 8 is a cross sectional view showing a state in which a surface fastener provided with fence portions made of foam is set in a metal mold.

With respect to the surface fastener shown in FIG. 6, in which the fence portions 2 made of the foam members 5 are bonded on the surface of the base portion 1, when the foam resin material 12 is injected and foamed in the metal mold 11 for molding a cushion body 10 of a seat as shown in FIG. 8, the fence portions 2 are embedded and fixed in the cushion body 10 so as to be slightly compressed by a molding pressure, because the fence portions 2 of the foam members 5 have flexibility. However, after the molding, the fence portions 2 exhibit flexibility to the same degree as the cushion body 10.

Figure 9:
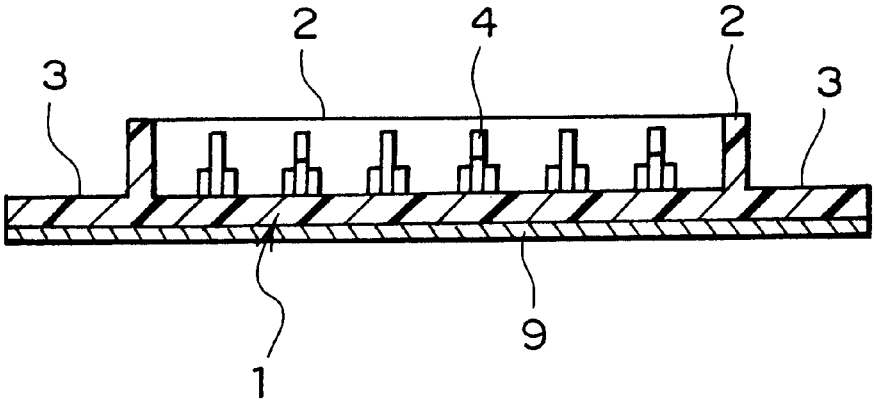
FIG. 9 is a cross sectional view of a surface fastener in which a magnetic film layer is disposed on a rear surface thereof.
Figure 10:
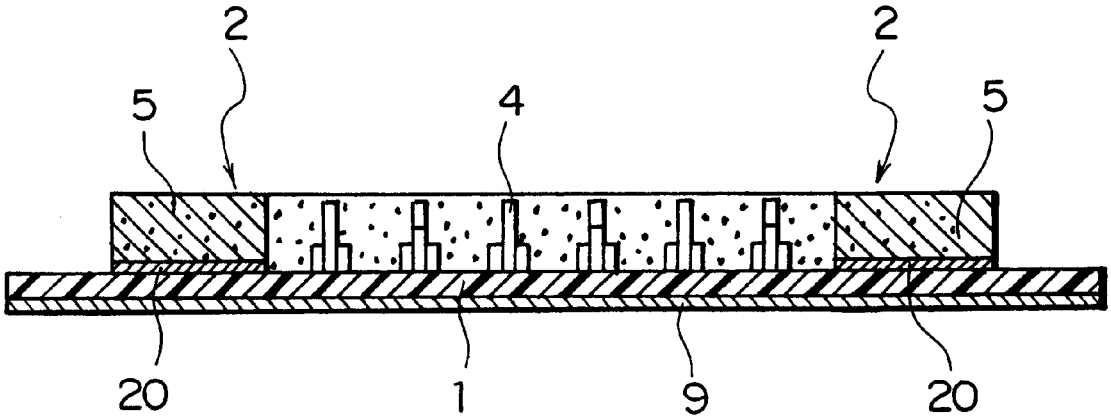
FIG. 10 is a cross sectional view of a surface fastener provided with fence portions made of foam, in which a magnetic film layer is disposed on a rear surface of a base portion thereof.
Figure 11:
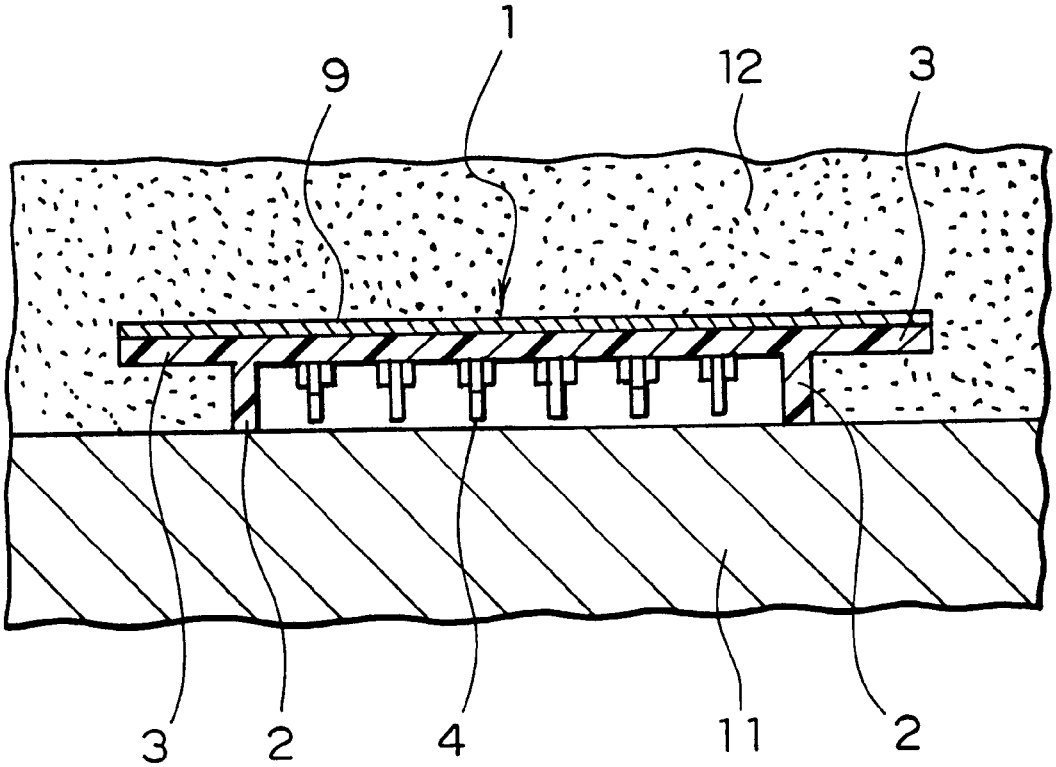
FIG. 11 is a cross sectional view showing a state in which a surface fastener with a magnetic film layer disposed on a rear surface thereof is set in a metal mold.
Figure 12:
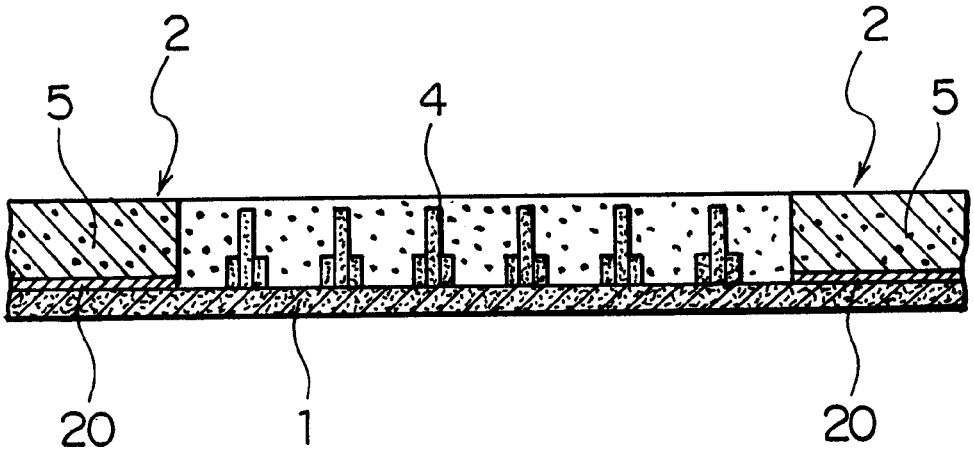
FIG. 12 is a cross sectional view of a surface fastener in which a base portion and engaging elements are molded integrally of resin mixed with magnetic powder.

In order that the fence portions 2 standing on the base portion 1 of the surface fastener are made to held on a wall of the metal mold 11 so as to be tightly contact therewith, a resin adhesive or resin coating, which are mixed with magnetic metal powder, is bonded or applied on a rear surface of the base portion 1 of the surface fastener so as to form a magnetic film layer 9, as shown in FIGS. 9 and 10. As shown in FIG. 11, this magnetic film layer 9 allows top ends of the fence portions 2, which protrude on the base portion 1 of the surface fastener, to be secured to the wall of the metal mold 11 by a magnetic force of a magnet (not shown) provided to the metal mold 11. In this state, the cushion body 10 is foamed and molded. Alternatively, the thermoplastic resin for molding the base portion 1, the attaching portions 3 and the engaging elements 4 of the surface fastener may be mixed with magnetic metal powder, to mold the surface fastener. Then, the top ends of the fence portions 2 formed of the foam members standing on the base portion 1 of the surface fastener are secured to the wall of the metal mold 11 by a magnetic force of a magnet provided on the metal mold 11. In this state, the cushion body 10 is foamed and molded. This mold surface fastener can be easily attached to the cushion body 10 and accurately embedded and fixed therein.

Next, each of the surface fasteners shown in FIGS. 13 to 16 is provided with three fixing yarns 6, which fix the surface fastener on the cushion body 10 of a foam resin molding type firmly, on a rear surface of the base portion 1. Any number of the fixing yarns 6 to be arranged may be available. The fixing yarns 6 are formed by entwining synthetic fibers such as polyamide fibers, polyester fibers, polypropylene fibers and the like, which are varied in crimp percentage, so as to be formed thick. Then, these fixing yarns 6 are pressed and fixed to the rear surface of the base portion 1 of the respective surface fastener pieces by a supersonic processing, a high-frequency processing or a hot melt adhesion processing. Alternatively, the fixing yarns 6 may be fixed by being pressed to the base portion 1 which is in a semi-molten state and penetrating the molten resin between the fibers. The fixing yarns 6 may be fixed to the base portion 1 by either completely bonding or partly bonding.

Figure 17:
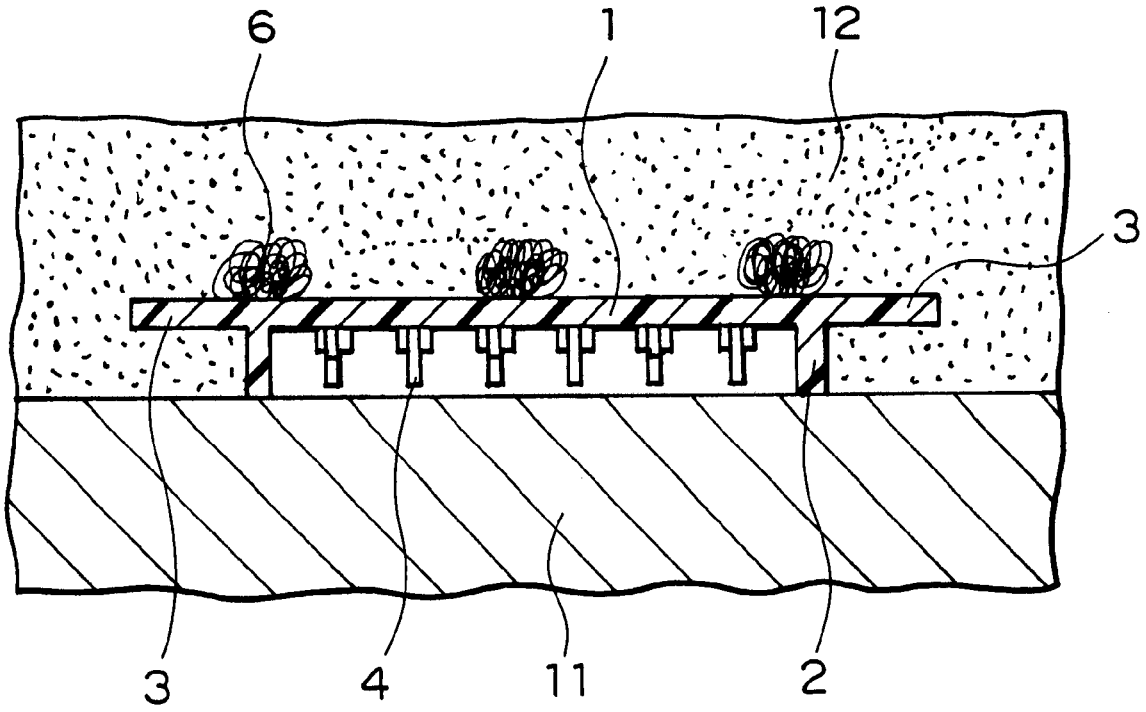
FIG. 17 is a cross sectional view showing a state in which the same surface fastener piece is set in a metal mold.

With respect to the surface fastener provided with the fixing yarns 6, as shown in FIG. 17, foam resin material 12 is injected in a metal mold 11 so as to be foamed therein while top ends of fence portions 2 provided on a base portion 1 of the surface fastener contact a wall of the metal mold 11 for molding a cushion body 10 of a seat. Then, the cushion body 10 wraps attaching portions 3 placed on the peripheries of the fence portions 2. At the same time, the foam resin material 12 penetrates the thick fixing yarns 6 attached to the rear surface of the base portion 1 to be solidified. As a result, the surface fastener can be strongly fixed in the cushion body 10. In this case, since the foam resin material 12 does not penetrate inside the fence portions 2, an engaging function of engaging elements 4 is not lost.

Further, synthetic fibers, which are applied with, resin coating mixed with metal fibers or magnetic metal powder may be employed for a part or all of the fibers constituting the fixing yarns 6. Consequently, the top ends of the fence portions 2 can be fixed to the wall of the metal mold 11 by the magnetic force of the magnet provided on the metal mold 11.

Figure 13:
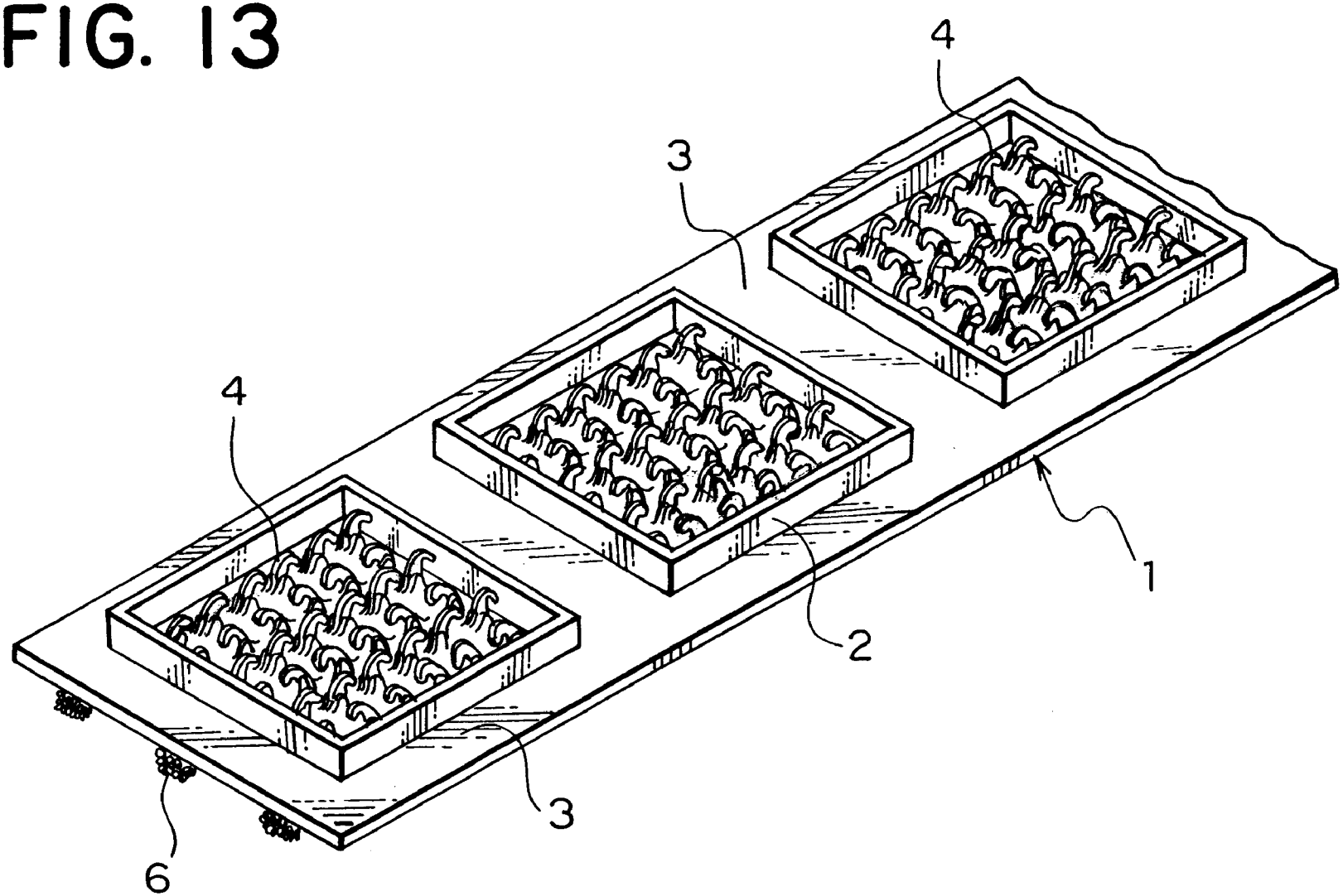
FIG. 13 is a perspective view of a strip-shaped surface fastener provided with fixing yarns.

In the above described surface fastener shown in FIG. 13, the base portion 1 of the surface fastener is formed in a strip shape, the fence portions 2 each of which is a square are arranged in a row with a space on a surface of the base portion 1, the attaching portions 3 are disposed between the respective fence portions 2 and on both outsides of the respective fence portions 2. Further, three fixing yarns 6 are attached on the rear surface of the base portion 1. In use of this surface fastener, the base portion 1 is cut at the respective attaching portions 3 in such a manner that a single fence portion 2 or a plurality of the fence portions 2 are arranged in a row in accordance with a size of the seat.

Figure 18:
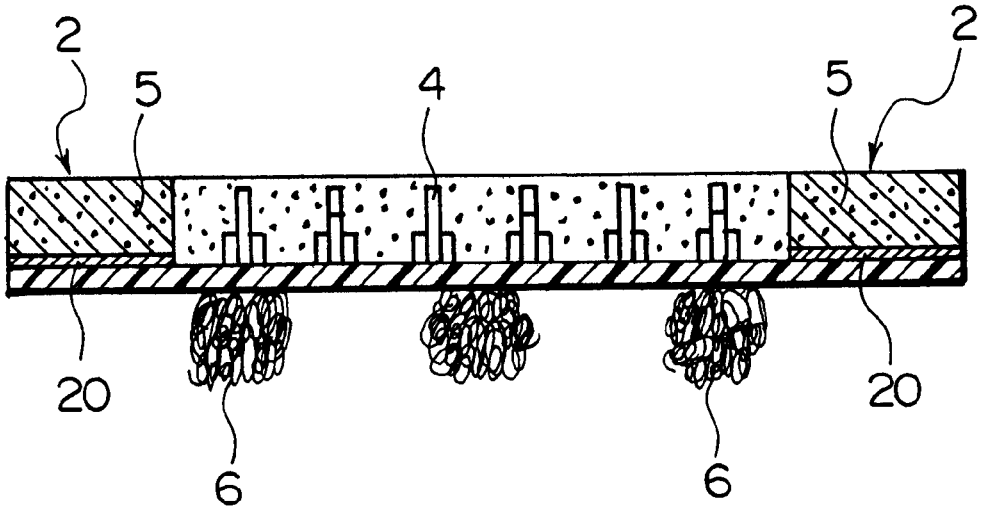
FIG. 18 is a cross sectional view of a surface fastener with fence portions made of foam, which is provided with fixing yarns.

With respect to a surface fastener shown in FIG. 18, fence portions 2 formed of foam members 5 are bonded to a surface of a base portion 1 by resin adhesive. Several fixing yarns 6 are fixed on a rear surface of the base portion 1, and the surface fastener is embedded and fixed in a cushion body 10 in the same way as that of the foregoing example.

Figure 19:
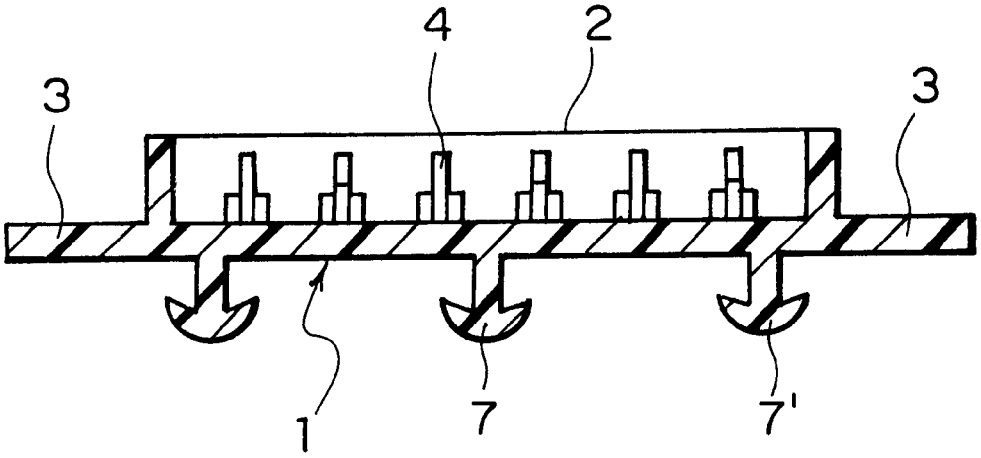
FIG. 19 is a cross sectional view of a surface fastener in which engaging elements for fixing are disposed on a rear surface thereof.

With respect to a surface fastener shown in FIG. 19, fixing elements 7, each of which has an enlarged head 7' with an appropriate shape on its tip end and which is a protrusion or a continuous protruded rib, is molded to be integral with a base portion 1 in place of the fixing yarns 6 disposed on a rear surface of the base portion 1. As a result, the base portion 1 of the surface fastener can be strongly embedded in a stable fashion and fixed together with attaching portions 3 in a deep portion of a cushion body 10 of foam resin molding type.

Figure 20:
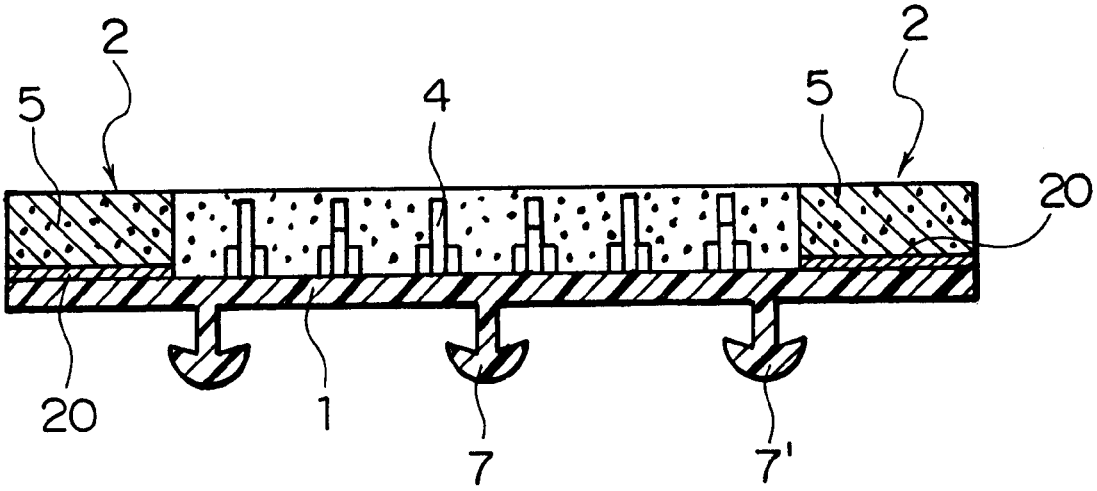
FIG. 20 is a cross sectional view of a surface fastener with fence portions made of foam, in which engaging elements for fixing are disposed.

With respect to a surface fastener shown in FIG. 20, fence portions 2 formed of foam members 5 are bonded on a surface of a base portion 1 by resin adhesive. Fixing elements 7, each of which has an enlarged head 7', are molded to be integral with the base portion 1 on a rear surface of the base portion 1. The usage manner is the same as that of the previous example.

Figure 21:
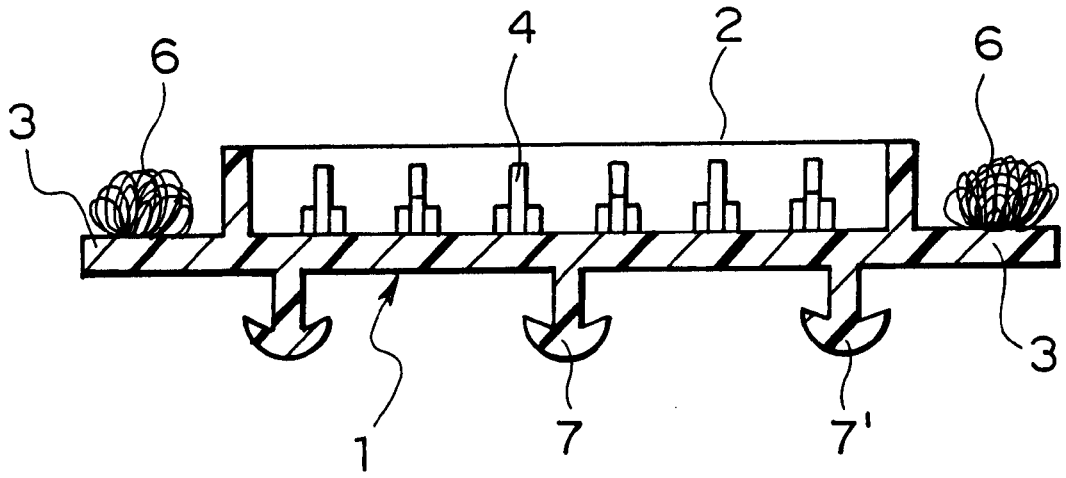
FIG. 21 is a cross sectional view of a surface fastener on which fixing yarns and fixing elements are disposed.

With respect to a surface fastener shown in FIG. 21, in addition to the structure of the surface fastener shown in FIG. 20, fixing yarns 6 are disposed on a surface of attaching portions 3 so as to extend in the same direction as the fixing elements 7. Consequently, upon embedding this surface fastener in a cushion body 10 of a foam resin molding type, it is possible to fix the attaching portions 3 of the base portion 1 more strongly and stably.

Figure 22:
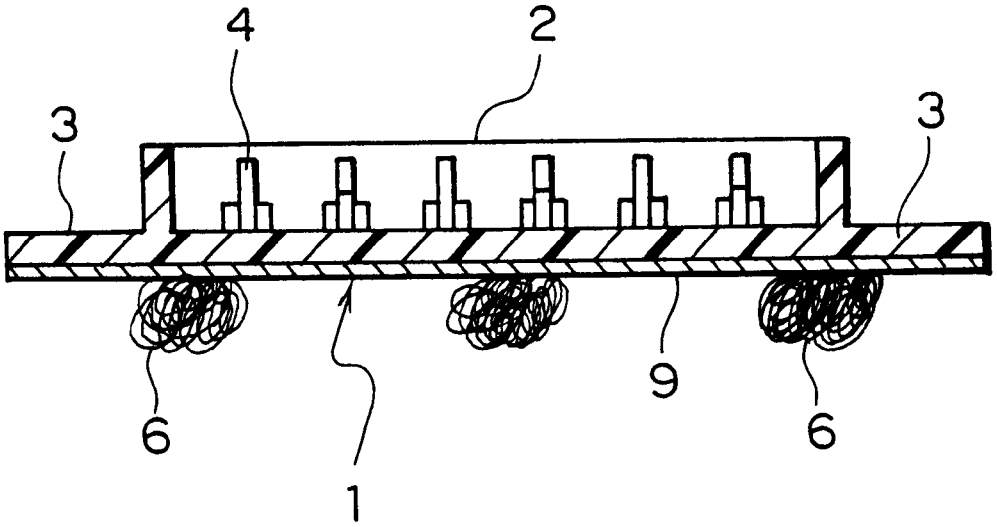
FIG. 22 is a cross sectional view of a surface fastener in which a magnetic film layer and fixing yarns are disposed on a rear surface thereof.

With respect to a surface fastener shown in FIG. 22, a rear surface of a base portion 1 thereof is formed with a magnetic film layer 9, which is formed by bonding or applying a resin adhesive or a resin coating mixed with magnetic metal on the rear surface. Then, thick fixing yarns 6 are bonded and fixed on an outer surface of the magnetic film layer 9 according to the above described method. This molding surface fastener can be easily positioned in a metal mold 11 by using the magnetic force, and it can be strongly embedded in a stable fashion and fixed in a deep portion of a cushion body 10.

Figure 23:
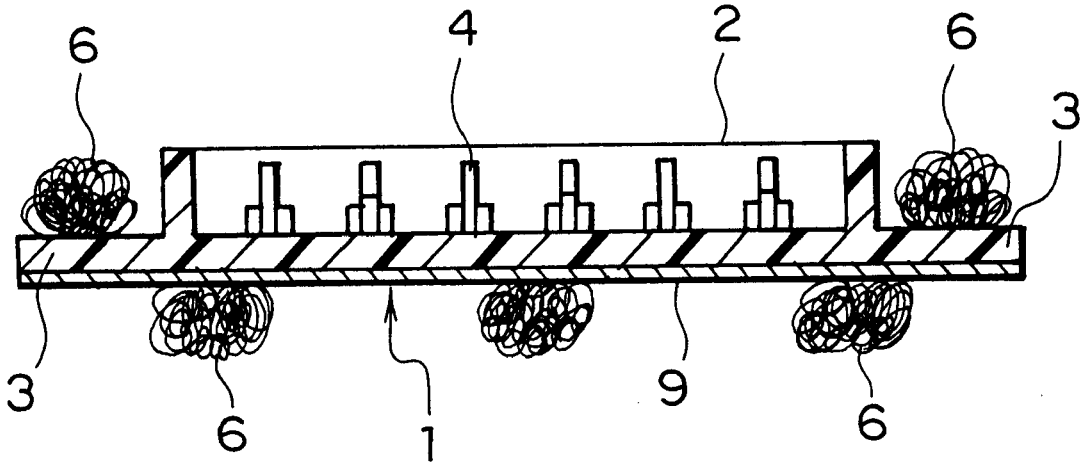
FIG. 23 is a cross sectional view of the same surface fastener, in which fixing yarns are disposed on both a front surface and a rear surface thereof.

With respect to a surface fastener shown in FIG. 23, a magnetic film layer 9 is formed on a rear surface of a base portion 1 of the surface fastener, thick fixing yarns 6 are bonded and fixed on an outer surface of the magnetic film layer 9, as in the same manner as the above described surface fastener shown in FIG. 22. Further, thick fixing yarns 6 are bonded and fixed on upper surfaces of attaching portions 3 on a surface of the base portion 1. Similarly to the previous example, this surface fastener can be easily positioned in a metal mold 11 by using the magnetic force, and it can be strongly embedded in a stable fashion and fixed in a cushion body 10 by the thick fixing yarns 6 attached on the rear surface of the base portion 1 and the thick fixing yarns 6 attached on the upper surfaces of the attaching portions 3.

Figure 24:
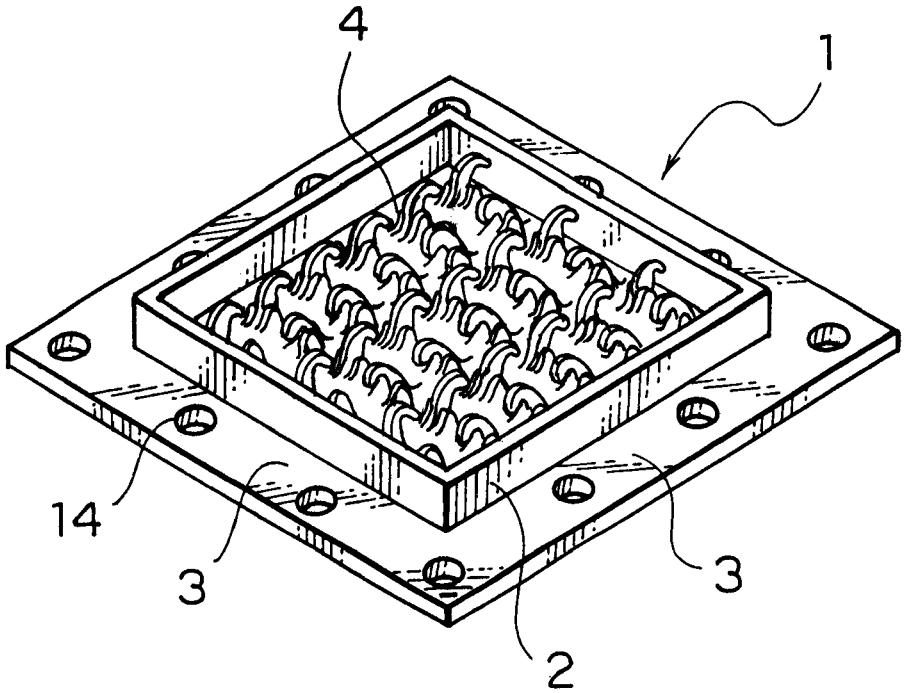
FIG. 24 is a perspective view of a surface fastener piece in which penetrating holes are defined on an attaching portion thereof.

With respect to a surface fastener piece shown in FIG. 24, a fence portion 2 is molded on a surface of a base portion 1 thereof in such a manner that periphery thereof is blocked. Male type engaging elements 4 of the surface fastener are integrally molded inside the fence portion 2, so that flat attaching portions 3, where no engaging elements 4 are disposed, are formed on the outer periphery of the fence portion 2. Further, penetrating holes 14 are defined on the attaching portions 3 with a predetermined space. When foam resin material 12 is foamed while a top end of the fence portion 2 of the surface fastener contact a metal mold 11, a cushion body 10 wraps the attaching portions 3 placed on the periphery of the fence portion 2 so as to be fixed, while the foam resin material 12 intrudes interiors of the penetrating holes 14. As a result, the surface fastener can be embedded and fixed in the cushion body 10. This structure may be applied to a strip-shaped surface fastener.

Figure 14:
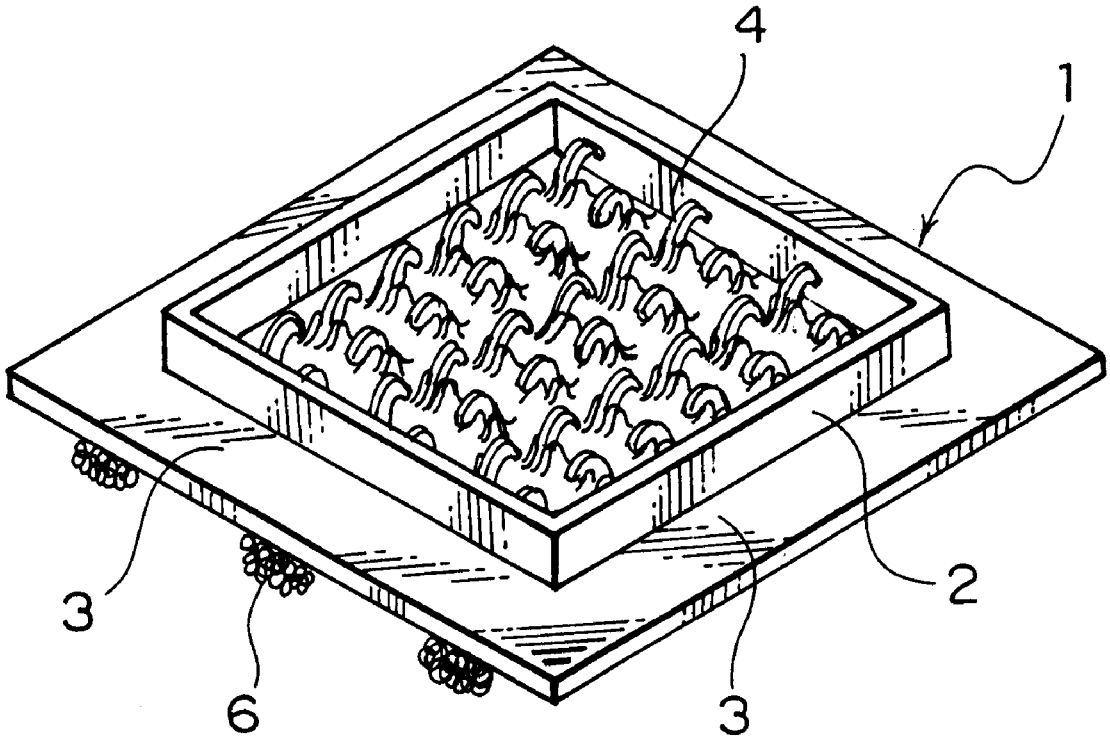
FIG. 14 is a perspective view of a surface fastener piece of the same.
Figure 15:
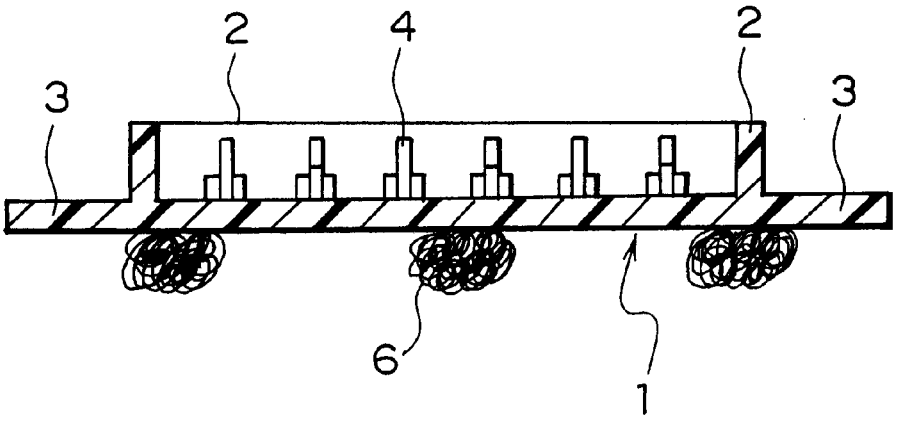
FIG. 15 is a cross sectional view of the surface fastener piece.
Figure 16:
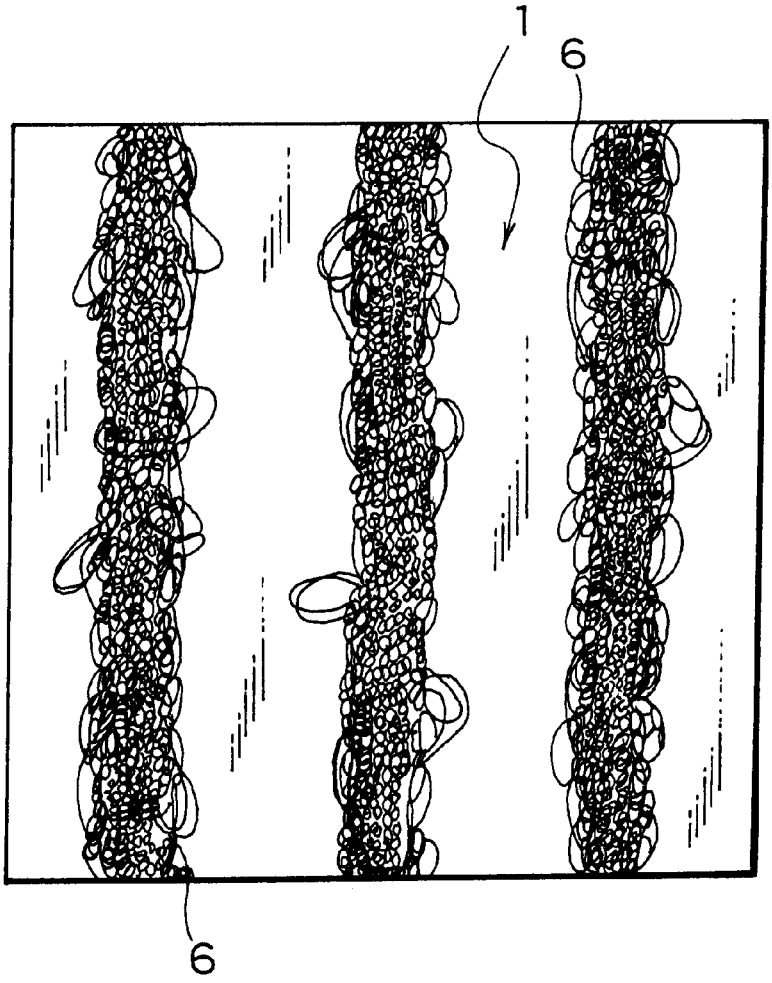
FIG. 16 is a rear surface view of the surface fastener piece.
Figure 25:
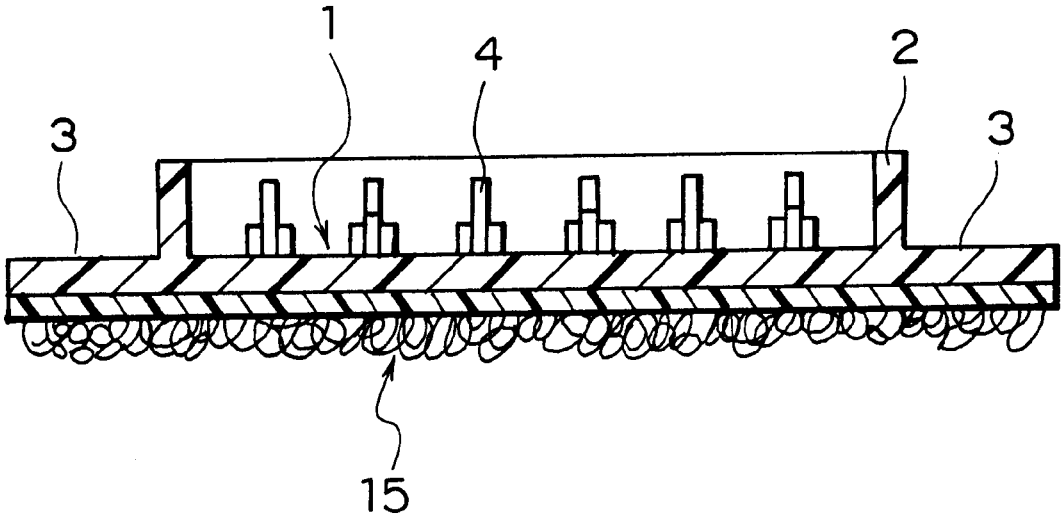
FIG. 25 is a cross sectional view of a surface fastener in which a non-woven cloth is disposed on a rear surface thereof.
Figure 26:
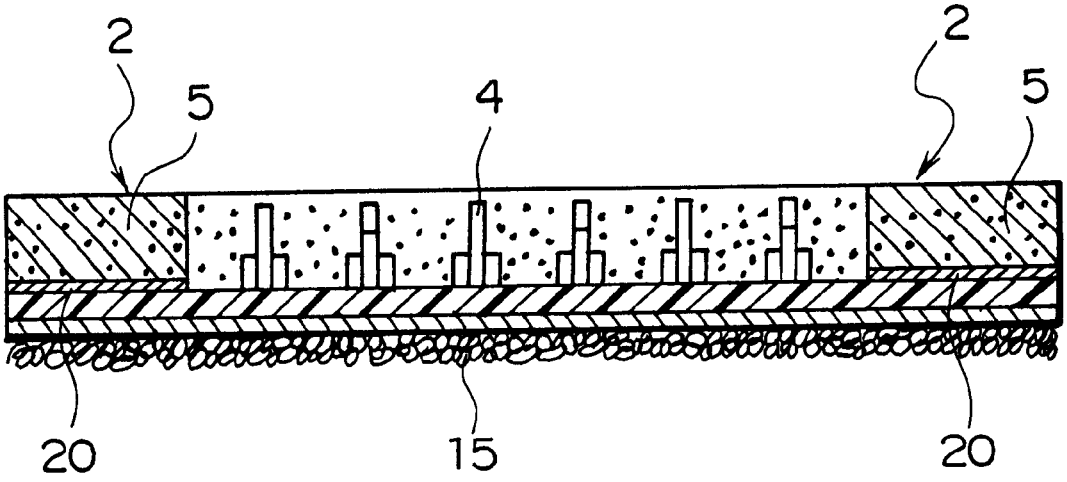
FIG. 26 is a cross sectional view of a surface fastener provided with fence portions made of foam, in which a non-woven cloth is disposed on a rear surface thereof.

A surface fastener shown in FIG. 25 has the same structure as that of the surface fastener shown in FIG. 14, except that a non-woven cloth 15 is fixed on a rear surface of a base portion 1 thereof in place of fixing yarns 6. With respect to a surface fastener shown in FIG. 26, fence portions 2 formed of foam members 5 are bonded on a surface of a base portion 1 thereof by resin adhesive, and a non-woven cloth 15 as a cloth is bonded and fixed on a rear surface of the base portion 1. The usage manner is the same as that of the previous example.

Figure 27:
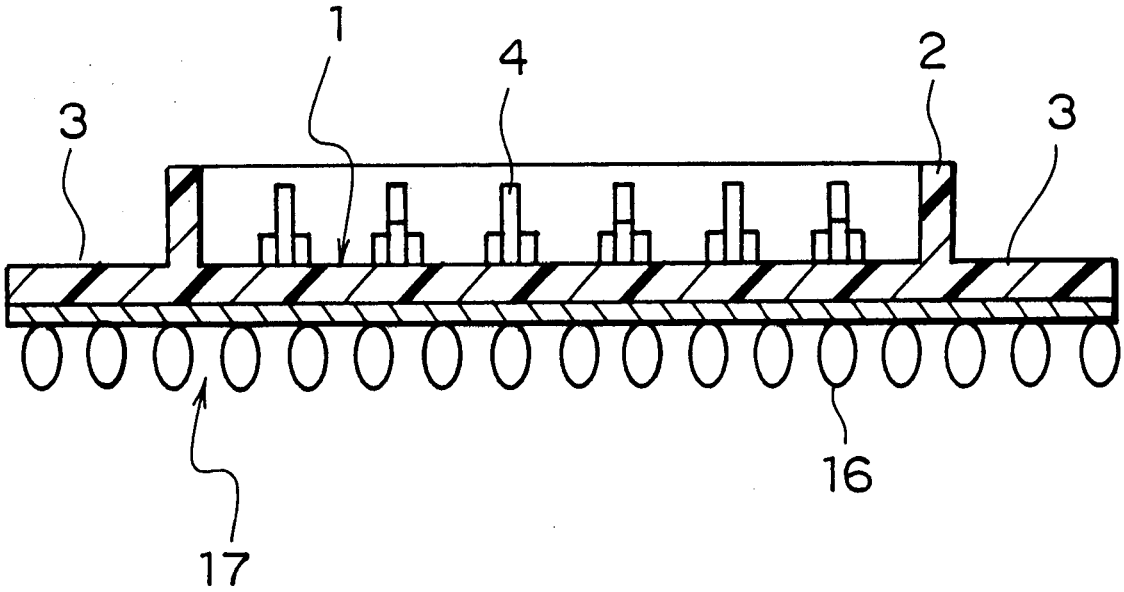
FIG. 27 is a cross sectional view of a surface fastener in which a female type fastener is disposed on a rear surface thereof.
Figure 28:
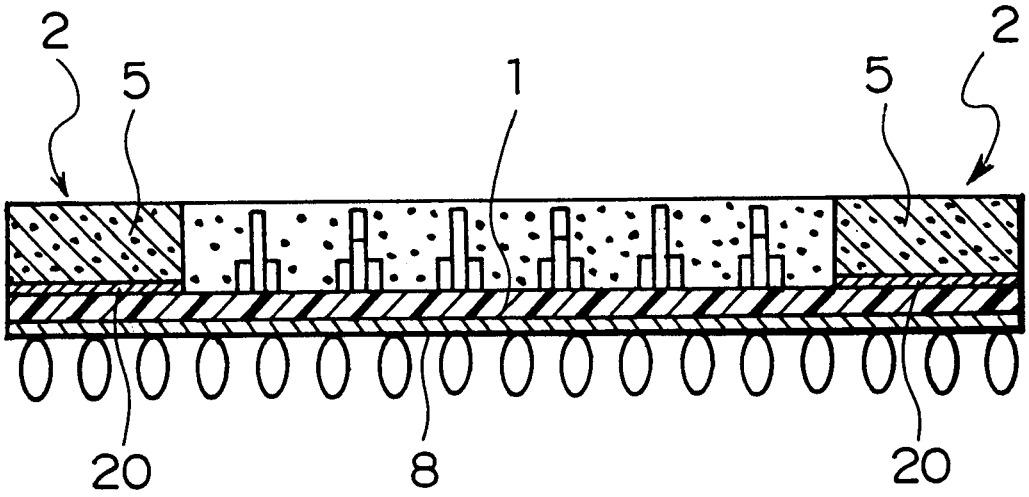
FIG. 28 is a cross sectional view of a surface fastener provided with fence portions made of foam, in which a female type fastener is disposed on a rear surface thereof.

With respect to a surface fastener shown in FIG. 27, a female surface fastener member 16, on which piles 17 are planted, as a cloth, is fixed on a rear surface of a base portion 1 thereof in place of fixing yarns 6. With respect to a surface fastener shown in FIG. 28, fence portions 2 formed of foam members 5 are bonded on a surface of a base portion 1 thereof by resin adhesive, and further, a female type surface fastener member 16 is fixed on a rear surface of the base portion 1, similarly to the previous example. The usage of this surface fastener is effected in the same manner as the surface fastener shown in FIG. 14.

Figure 29:
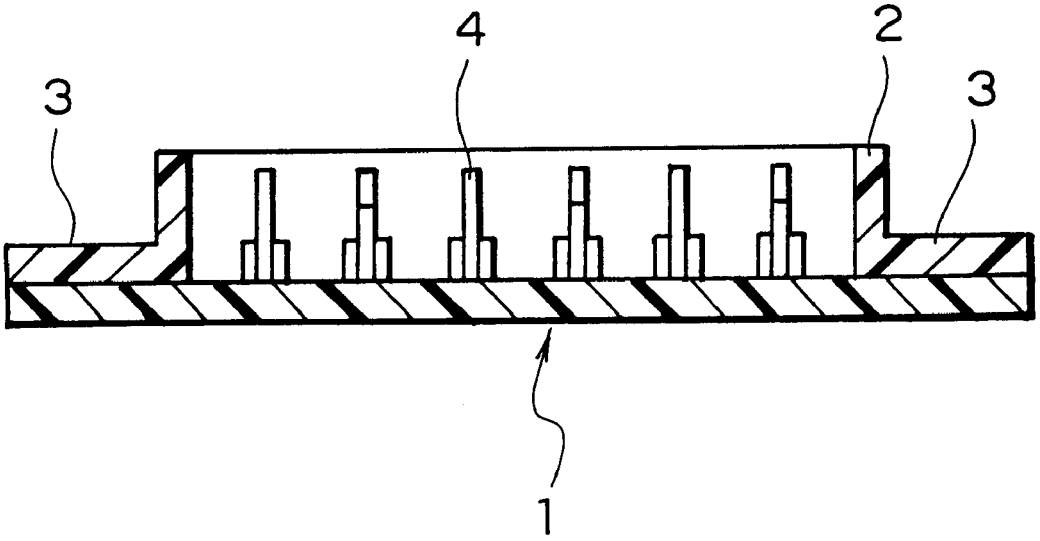
FIG. 29 is a cross sectional view of a surface fastener to which a separate base portion and a fence portion are fixed.

With respect to a surface fastener shown in FIG. 29, male type engaging elements 4 of the surface fastener are integrally molded on a center of a surface of a base portion 1 thereof, and fence portions 2 are molded independently of the base portion 1. Then, by a supersonic processing, a high-frequency processing, a hot melt adhesion processing or the like, the fence portions 2 are bonded and integrally fixed on the surface of the base portion 1 so as to surround a periphery of an array of the male type engaging elements 4.

Figure 30:
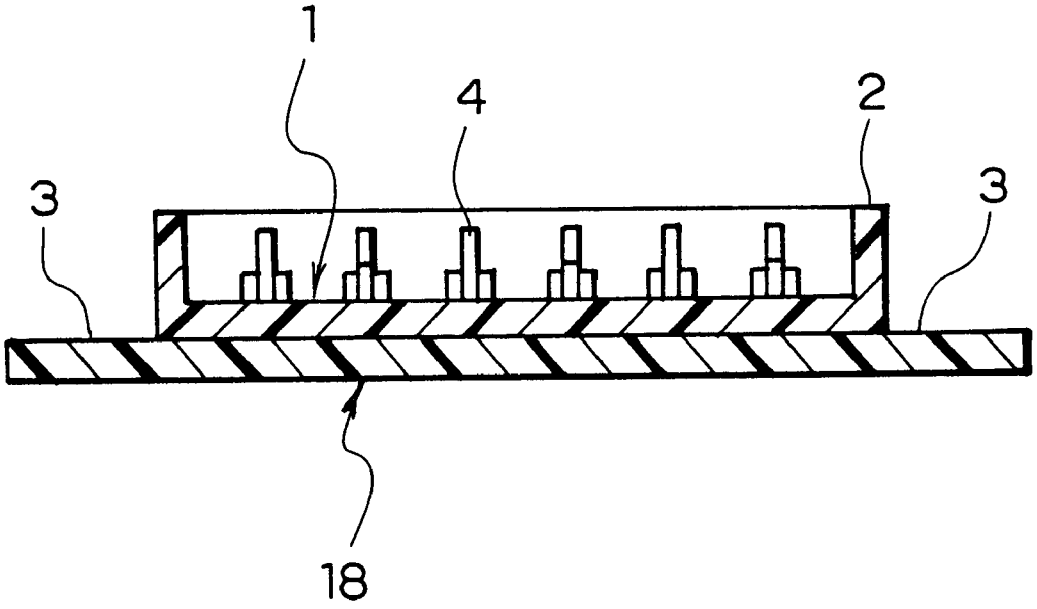
FIG. 30 is a cross sectional view of a surface fastener to which a separate base portion and a sheet member are fixed.

With respect to a surface fastener shown in FIG. 30, fence portions 2 are integrally molded on a surface of a base portion 1, and male type engaging elements 4 are integrally molded in an interior of each of the fence portions 2. Attaching portions 3 are not integrally formed to the base portion 1. Instead, a rear surface of the base portion 1 is bonded and integrally fixed on a center of a surface of a flat sheet member 18, which is made of synthetic resin and is has a larger size in all directions than the base portion 1, by a supersonic processing, a high-frequency processing, a hot melt adhesion processing or the like, so that the attaching portions 3 are defined on outer peripheries of the fence portions 2.

Figure 31:
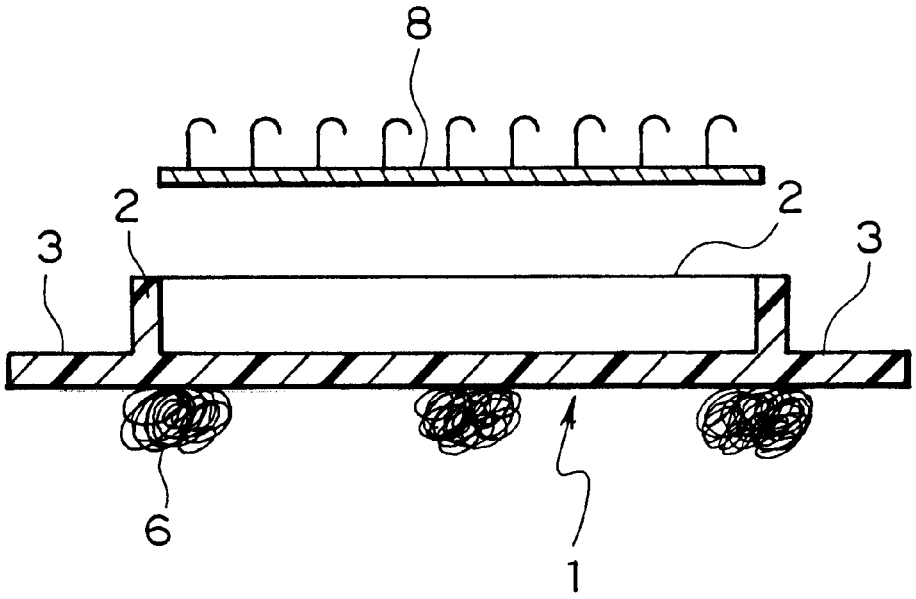
FIG. 31 is an exploded cross sectional view of a surface fastener in which a woven or knitted surface fastener member is used.

With respect to a surface fastener shown in FIG. 31, a base portion 1 and fence portions 2 thereof are integrally molded with each other, and fixing yarns 6 are bonded on a rear surface of the base portion 1 according to the above described method. On inner surfaces of the fence portions 2 disposed on a surface of the base portion 1, engaging elements 4 are not integrally molded but a woven, knitted or synthetic-resin-made surface fastener member 8 is attached or bonded. Therefore, it is possible that not only male type engaging elements 4 but also female type engaging elements 4 are provided in the inner surfaces of the fence portions 2, so that a convenient surface fastener can be obtained.

Figure 32:
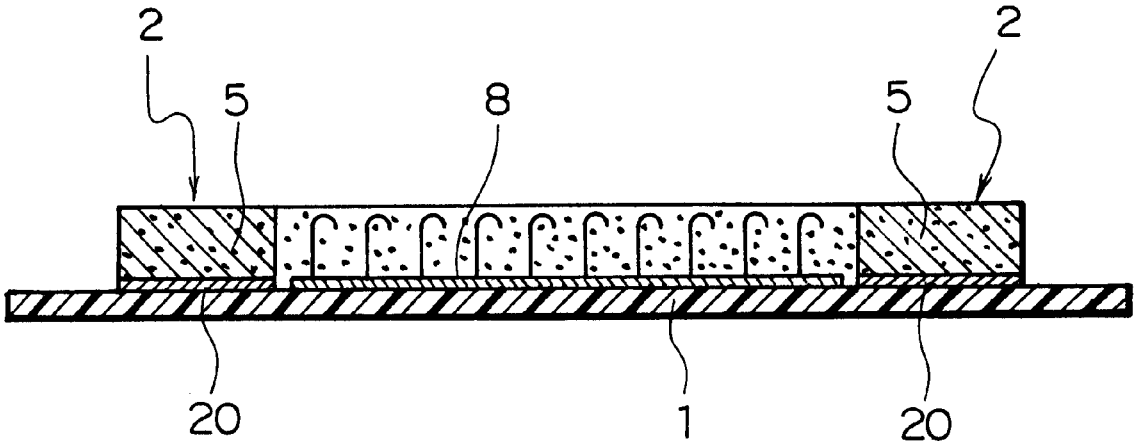
FIG. 32 is a cross sectional view of a surface fastener provided with fence portions made of foam, in which a woven surface fastener member is disposed.
Figure 33:
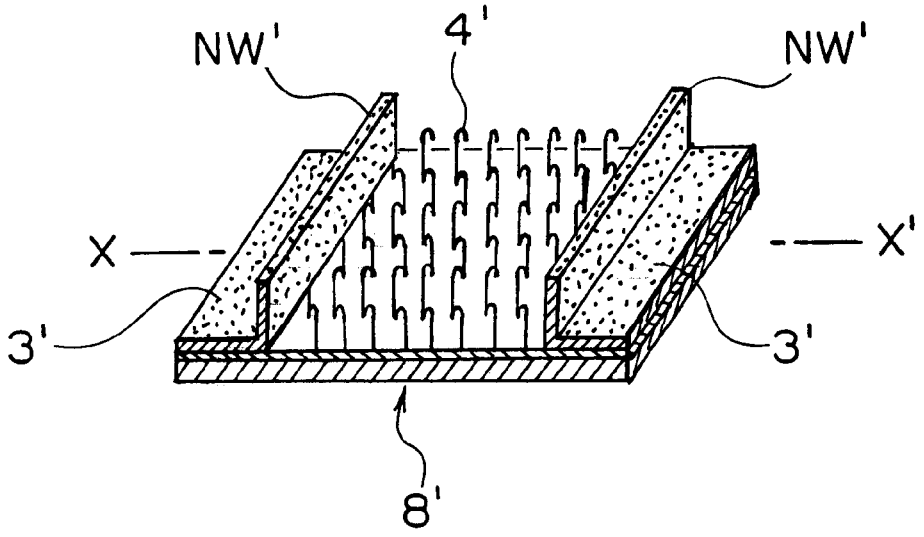
FIG. 33 PRIOR ART
FIG. 33 is a perspective view of a known woven surface fastener piece.
Figure 34:
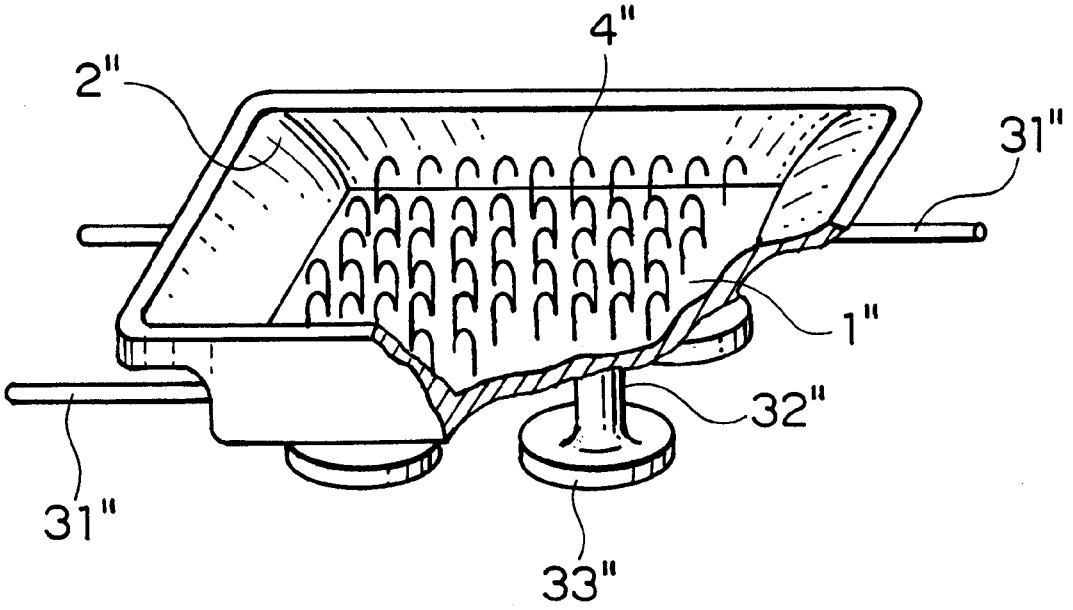
FIG. 34 PRIOR ART
FIG. 34 is a perspective view of a further known surface fastener piece, which is molded.

Finally, with respect to a surface fastener shown in FIG. 32, fence portions 2 formed of foam members 5 are bonded on a surface of a base portion 1 thereof by resin adhesive, and a woven or knitted male surface fastener member 16 is bonded and fixed at an inner surface of each of the fence portions 2 on the surface of the base portion 1 by adhesive or the like. Therefore, it is possible to obtain a surface fastener, in which both of the fence portions 2 and the engaging elements 4 have flexibility.

The surface fastener according to the present invention has structures as described above. These structures bring about the following effects.

According to the present invention, there is provided a surface fastener, comprising a strip-shaped flat base portion 1 made of thermoplastic resin, a number of fence portions 2 arranged in a row on a surface of the base portion 1, a periphery of each of the fence portions 2 being blocked, engaging elements 4 planted inside each of the fence portions 2, and an attaching portion 3, where no engaging elements 4 are disposed, integrally defined between the respective fence portions 2.

Therefore, it is possible to easily manufacture a strip-shaped surface fastener provided with attaching portions 3, and it is possible to attach the surface fastener in a stable manner to a cushion body 10 for a seat. Additionally, upon engaging the surface fastener with engaging elements of a companion surface fastener disposed on the seat, the fence portions 2 prevent the engaging elements inside the fence portions from being crushed, so that the surface fastener can be appropriately engage with the engaging elements of the companion surface fastener in a stable fashion. Further, since the surface fastener does not protrude out of the cushion body 10, it does not make a user feel uncomfortable and the inventory control of the surface fastener can be easily carried out.

Furthermore, since the attaching portion 3, on which no engaging elements 4 are disposed, is further defined on each side of the respective fence portions 2 arranged in a row on the surface of the base portion 1, the surface fastener can be fixed in the cushion body 10 for a seat more stably.

Still further, since the strip-shaped base portion 1 and the fence portions 2 are integrally molded of thermoplastic resin, the surface fastener can be manufactured in a very simply manner.

Still further, since the strip-shaped base portion 1 and the fence portions 2 formed of thermoplastic resin foam members 5 are bonded to each other, the surface fastener is provided with the fence portions 2 having flexibility, which can be manufactured by simple means.

Still further, since the strip-shaped base portion 1 is cut at an interspace between the respective fence portions 2 so that surface fastener pieces each including a single fence portion 2 or a plurality of fence portions 2 can be formed, it is possible to easily manufacture a surface fastener in a single unit or in plural units, depending a place and a purpose for its use.

Still further, since the fixing yarns 6 are disposed the rear surface of the base portion 1 or/and on the attaching portion 3, or a cloth which foam resin material can penetrate, or fixing elements 7 each having an enlarged head 7' is/are disposed on the rear surface of the base portion 1, the surface fastener can be fixed in the cushion body 10 for a seat strongly in a stable manner.

Still further, since resin adhesive or resin coating mixed with magnetic powder is applied on the rear surface of the base portion 1 so as to form a magnetic film layer 9, or since the base portion 1 and the engaging elements 4 are integrally molded by using thermoplastic resin mixed with magnetic powder, or since the base portion 1 and the fence portions 2 are bonded to each other by using resin adhesive mixed with magnetic powder, the surface fastener can be set effectively in a metal mold 11 while being in tight contact with the metal mold 11, so that the surface fastener having good quality can be obtained.

Still further, since a woven or knitted surface fastener member 16 is disposed inside each of the fence portions 2 of the base portion 1, it is possible to obtain a surface fastener provided with the engaging elements having flexibility.

Still further, since the fixing yarns 6 are formed to be thick by entwining fibers which are varied in crimp percentage, or/and since magnetic material is included in the fixing yarns 6, it is possible to easily manufacture the fixing yarns 6 that can strongly fix the surface fastener to the cushion body 10. Therefore, as described above, the effects according to the present invention are quite distinguishing.

What is claimed:

1. A surface fastener, comprising a strip-shaped flat base portion made of thermoplastic resin, a number of fence portions arranged in a row on a surface of the base portion, a periphery of each of the fence portions being blocked, engaging elements planted inside each of the fence portions, and an attaching portion, where no engaging elements are disposed, integrally defined between the respective fence portions.

2. A surface fastener according to claim 1, wherein the attaching portion, on which no engaging elements are disposed, is further defined on each side of the respective fence portions arranged in a row on the surface of the base portion.

3. A surface fastener according to claim 1, wherein the strip-shaped base portion and the fence portions are integrally molded of thermoplastic resin.

4. A surface fastener according to claim 1, wherein the strip-shaped base portion and the fence portions formed of thermoplastic resin foam members are bonded to each other.

5. A surface fastener according to claim 1, wherein the strip-shaped base portion is cut at an interspace between the respective fence portions so that surface fastener pieces each including a single fence portion or a plurality of fence portions are formed.

6. A surface fastener according to claim 1, wherein fixing yarns are arranged on a rear surface of the base portion or/and on the attaching portion.

7. A surface fastener according to claim 1, wherein a cloth which foam resin material can penetrate are arranged on a rear surface of the base portion.

8. A surface fastener according to claim 1, wherein fixing elements each having an enlarged head are integrally molded on a rear surface of the base portion.

9. A surface fastener according to claim 1, wherein resin adhesive or resin coating mixed with magnetic powder is applied on a rear surface of the base portion so as to form a magnetic film layer.

10. A surface fastener according to claim 1, wherein the base portion and the engaging elements are integrally molded by using thermoplastic resin mixed with magnetic powder.

11. A surface fastener according to claim 1, wherein a woven or knitted surface fastener member is disposed inside each of the fence portions of the base portion.

12. A surface fastener according to claim 4, wherein the base portion and the fence portions are bonded to each other by using resin adhesive mixed with magnetic powder.

13. A surface fastener according to claim 6, wherein the fixing yarns are formed to be thick by entwining fibers which are varied in crimp percentage.

14. A surface fastener according to claim 13, wherein magnetic material is included in the fixing yarns.

* * * * *